US011372363B2

(12) United States Patent
Inoue et al.

(10) Patent No.: US 11,372,363 B2
(45) Date of Patent: Jun. 28, 2022

(54) IMAGE FORMING APPARATUS AND IMAGE FORMING METHOD

(71) Applicant: RICOH COMPANY, LTD., Tokyo (JP)

(72) Inventors: Daisuke Inoue, Shizuoka (JP); Shinya Nakayama, Shizuoka (JP); Yohichi Kitagawa, Shizuoka (JP); Takaaki Tawada, Kanagawa (JP); Kenji Komito, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 18 days.

(21) Appl. No.: 17/112,452

(22) Filed: Dec. 4, 2020

(65) Prior Publication Data

US 2021/0173337 A1 Jun. 10, 2021

(30) Foreign Application Priority Data

Dec. 6, 2019 (JP) ..... JP2019-221412

(51) Int. Cl.
*G03G 21/00* (2006.01)
*G03G 9/08* (2006.01)
(Continued)

(52) U.S. Cl.
CPC ..... *G03G 21/0017* (2013.01); *G03G 9/0819* (2013.01); *G03G 9/09725* (2013.01); *G03G 9/10* (2013.01)

(58) Field of Classification Search
CPC ..... G03G 21/0017; G03G 9/0819; G03G 9/09725; G03G 9/10
See application file for complete search history.

(56) References Cited

U.S. PATENT DOCUMENTS

2006/0292473 A1* 12/2006 Kadokura ..... G03G 9/09725 430/108.1
2008/0241716 A1 10/2008 Ishikawa et al.
(Continued)

FOREIGN PATENT DOCUMENTS

EP 1220043 A2 * 7/2002 ..... G03G 9/0806
EP 2799929 A1 * 11/2014 ..... G03G 9/0821
(Continued)

OTHER PUBLICATIONS

U.S. Appl. No. 16/961,093, filed Dec. 21, 2018, Akio Takei, et al.

*Primary Examiner* — Ryan D Walsh
(74) *Attorney, Agent, or Firm* — Grüneberg and Myers PLLC

(57) ABSTRACT

An image forming apparatus is provided. The image forming apparatus includes an image bearer and a cleaning blade configured to remove toner particles remaining on the image bearer. The cleaning blade includes an elastic member in contact with a surface of the image bearer to remove the toner particles. The elastic member has a Martens hardness of from 3 to 8 N/mm$^2$ when measured by a nanoindentation method with a load of 1 μN. The toner particles comprise toner base particles and an external additive, and the external additive comprise silica particles. A liberation ratio (Xs) of the silica particles liberated from the toner particles is from 40% to 75% when measured by an ultrasonic vibration method. A proportion (R70) of the silica particles having a volume-based particle diameter of 70 nm or more in the silica particles liberated from the toner particles is from 70% to 90% by number.

8 Claims, 6 Drawing Sheets

(51) Int. Cl.
*G03G 9/10* (2006.01)
*G03G 9/097* (2006.01)

(56) References Cited

U.S. PATENT DOCUMENTS

| | | | | |
|---|---|---|---|---|
| 2013/0196261 | A1* | 8/2013 | Uchinokura | G03G 9/09716 430/108.4 |
| 2014/0220485 | A1* | 8/2014 | Kojima | G03G 9/08797 430/108.7 |
| 2015/0253722 | A1* | 9/2015 | Sakaguchi | G03G 21/0017 399/350 |
| 2016/0109846 | A1* | 4/2016 | Shimizu | B32B 7/022 399/350 |
| 2016/0209766 | A1 | 7/2016 | Chiba et al. | |
| 2016/0209767 | A1 | 7/2016 | Nagata et al. | |
| 2016/0231661 | A1 | 8/2016 | Nagai et al. | |
| 2016/0259257 | A1 | 9/2016 | Sugimoto et al. | |
| 2016/0259293 | A1 | 9/2016 | Shimizu et al. | |
| 2016/0334726 | A1 | 11/2016 | Sakashita et al. | |
| 2016/0378006 | A1 | 12/2016 | Itoh et al. | |
| 2017/0010550 | A1 | 1/2017 | Nagata et al. | |
| 2017/0017175 | A1 | 1/2017 | Yamada et al. | |
| 2017/0038724 | A1 | 2/2017 | Shimizu et al. | |
| 2017/0068207 | A1 | 3/2017 | Shimizu et al. | |
| 2017/0146944 | A1 | 5/2017 | Shimizu et al. | |
| 2017/0199493 | A1 | 7/2017 | Watanabe et al. | |
| 2017/0363980 | A1 | 12/2017 | Nagata et al. | |
| 2018/0024452 | A1 | 1/2018 | Sugimoto et al. | |
| 2018/0052403 | A1 | 2/2018 | Inoue et al. | |
| 2018/0321606 | A1 | 11/2018 | Ohnuma et al. | |
| 2020/0103775 | A1 | 4/2020 | Kitagawa et al. | |
| 2020/0292954 | A1 | 9/2020 | Aoyama et al. | |
| 2020/0301348 | A1 | 9/2020 | Nakayama et al. | |

FOREIGN PATENT DOCUMENTS

| | | | | |
|---|---|---|---|---|
| JP | 4-212190 | | 8/1992 | |
| JP | 9-127846 | | 5/1997 | |
| JP | 9-166919 | | 6/1997 | |
| JP | 2004-233818 | | 8/2004 | |
| JP | 2005037469 | A * | 2/2005 | G03G 9/09708 |
| JP | 2006-184875 | | 7/2006 | |
| JP | 2006-215532 | | 8/2006 | |
| JP | 2009-031719 | | 2/2009 | |
| JP | 2010-152295 | | 7/2010 | |
| JP | 2014-164034 | | 9/2014 | |
| WO | WO-2015030120 | A1 * | 3/2015 | G03G 21/0017 |

* cited by examiner

COMPARATIVE EXAMPLE

COMPARATIVE EXAMPLE

COMPARATIVE EXAMPLE

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2019-221412, filed on Dec. 6, 2019, in the Japan Patent Office, the entire disclosure of which is hereby incorporated by reference herein.

BACKGROUND

Technical Field

The present disclosure relates to an image forming apparatus and an image forming method.

Description of the Related Art

In a conventional electrophotographic image forming apparatus, after a toner image on an image bearer has been transferred onto a transfer sheet or an intermediate transferor, unnecessary substances adhered to the surface of the image bearer, such as untransferred residual toner particles, are removed from the image bearer by a cleaner.

As the cleaner, a strip-shaped cleaning blade is generally well known because of its simple structure and excellent cleaning performance. Specifically, with a base end of the cleaning blade supported by a support and a contact part (leading end ridge part) pressed against the peripheral surface of the image bearer, the cleaning blade dams up residual toner particles remaining on the image bearer and scrapes them off.

On the other hand, in response to a recent demand for higher image quality, the need for image forming apparatuses using a toner having a small particle diameter and a nearly spherical shape manufactured by a chemical method or the like has been increasing. Such a toner is more difficult to remove with a cleaning blade compared to a conventional toner manufactured by a kneading-pulverizing method. This is because the toner having a small particle diameter and a high sphericity slips through a slight gap formed between the cleaning blade and the image bearer.

Such slippage of toner may be prevented by increasing the contact pressure between the image bearer and the cleaning blade. However, when the contact pressure is increased, the cleaning blade may be turned up as illustrated in FIG. 1A. Further, when used in a turned-up state, the cleaning blade is locally worn as illustrated in FIG. 1B, and the leading end ridge part is finally worn as illustrated in FIG. 1C. As a result, the lifespan of the cleaning blade is shortened, and defective cleaning is likely to occur.

Generally, the surface of toner is covered with an additive comprised of, for example, inorganic particles such as silica and titanium oxide, to impart fluidity and chargeability. It is known that the additive is liberated from the toner which is dammed by the cleaning blade on the image bearer and supplied to the contact part between the cleaning blade and the image bearer, thus forming an accumulated layer of the additive. The accumulated layer works as a lubricant between the cleaning blade and the image bearer.

In recent years, there has been a demand for a higher-speed image forming apparatus. However, as the speed is increased, axial runout or fine vibration of the image bearer occurs. In this situation, the conventional cleaning blades are insufficient in ability to follow the surface of the image bearer (hereinafter "followability") and in cleaning performance at high-speed regions.

SUMMARY

In accordance with some embodiments of the present invention, an image forming apparatus is provided. The image forming apparatus includes an image bearer and a cleaning blade configured to remove toner particles remaining on the image bearer. The cleaning blade includes an elastic member in contact with a surface of the image bearer to remove the toner particles. The elastic member has a Martens hardness of from 3 to 8 N/mm$^2$ when measured by a nanoindentation method with a load of 1 μN. The toner particles comprise toner base particles and an external additive, and the external additive comprise silica particles. A liberation ratio (Xs) of the silica particles liberated from the toner particles is from 40% to 75% when measured by an ultrasonic vibration method. A proportion (R70) of the silica particles having a volume-based particle diameter of 70 nm or more in the silica particles liberated from the toner particles is from 70% to 90% by number.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1A:
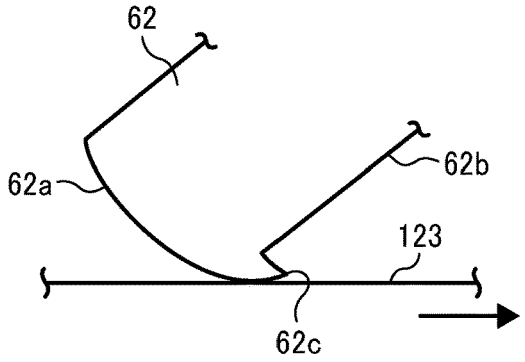
FIG. 1A is a diagram illustrating a state in which a leading end ridge part of a cleaning blade is turned up.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, an image forming apparatus is provided in which a cleaning blade is prevented from being turned up at a leading end ridge part or being locally worn or chipped and in which an image bearer is prevented from being contaminated (filmed) with an additive of toner, to maintain excellent cleaning performance for an extended period of time and prevent the occurrence of an abnormal image.

Embodiments of the present invention are described in detail below.

The cleaning blade according to an embodiment of the present invention is given a high hardness to scrape off substances (e.g., additives such as external additives) adhered to the surface of an image bearer (also referred to as "photoconductor") to prevent the occurrence of filming due to adhesion of the external additives or the like. When the Martens hardness HM of the elastic member of the cleaning blade measured by a nanoindentation method with a load of 1 μN is from 3 to 8 $N/mm^2$, the cleaning blade effectively dams up the toner and the additive liberated from the toner to ensure good filming resistance and cleaning performance. When the Martens hardness HM is smaller than 3 $N/mm^2$, the cleaning blade is insufficient in hardness and the ability to dam up the toner is reduced, thereby causing filming and defective cleaning. When the Martens hardness HM is higher than 8 $N/m^2$, in a case in which the additive supplied to the contact part between the cleaning blade and the image bearer slips therethrough, a part of the leading end ridge part may be chipped, or the additive may be strongly pressed against the image bearer to cause filming on the image bearer and generate an abnormal image. A method for measuring the Martens hardness HM is described in detail later.

According to the study by the inventors of the present invention, it has been found that, when the amount of external additives supplied to the contact part between the cleaning blade and the image bearer is increased, the external additives present between the cleaning blade and the image bearer develop a lubricating function. Further, especially when silica particles having a specific amount of a large particle diameter of 70 nm or more as the external additives are supplied to the contact part between the cleaning blade and the image bearer, the silica particles accumulate as a dam layer at a blade nip portion and develop a lubricating function. This stabilizes the behavior of the tip of the cleaning blade. As a result, the contact pressure of the cleaning blade against the image bearer makes the cleaning performance better, the stress between the image bearer and the cleaning blade is reduced, wear of the image bearer or the cleaning blade is reduced, and the occurrence of filming of the additive of toner is prevented. On the other hand, when silica particles having a small particle diameter of less than 70 nm are used in an amount beyond a specific amount, the silica particles easily slip through the blade, and filming and defective cleaning occur. Therefore, in order to ensure good cleanability and to suppress medaka filming while preventing chipping of the blade, it is preferable that the toner be given an ability to liberate silica particles having a large particle diameter, specifically, silica particles having a particle diameter of 70 nm or more.

The toner according to an embodiment of the present invention includes toner base particles and an external additive containing silica particles. A liberation ratio Xs of the silica particles liberated from the toner is from 40% to 75% when measured by an ultrasonic vibration method. A proportion R70 of the silica particles having a volume-based particle diameter of 70 nm or more in the silica particles liberated from the toner is from 70% to 90% by number.

When the liberation ratio Xs is less than 40%, a dam layer cannot be sufficiently formed at the blade nip portion, resulting in poor cleanability. When the liberation ratio Xs is larger than 75%, the excessively-liberated external additives slip through the blade and cause filming. The liberation ratio Xs can be kept within the range of from 40% to 75% by adjusting the amount of silica to be added or adjusting the peripheral stirring speed and stirring time in the process of mixing the toner base particles and the external additive.

When the proportion R70 is less than 70% by number, it indicates that the proportion of large-particle-diameter silica particles which enter into the blade nip portion is small. As a result, a dam layer is not sufficiently formed, the stress between the image bearer and the cleaning blade cannot be reduced, blade chipping occurs, slip-through of small-particle-diameter silica particles increases, and filming occurs. When the proportion R70 is larger than 90% by number, the excessively-liberated external additives slip through the blade and cause filming.

Methods for measuring the liberation ratio Xs and the proportion R70 are described in detail later.

Preferably, the liberation ratio Xs is from 60% to 70%.

Preferably, the proportion R70 is from 70% to 80% by number.

As a result of diligent studies of the inventors of the present invention, it has been found that, when at least two types of silica particles having different volume average particle diameters are used, in other words, silica particles having a large volume average particle diameter and silica particles having a small volume average particle diameter are used, the above-described effect of the present invention is further enhanced.

That is, it is preferable that the silica particles contained in the external additive comprise at least two types of silica particles having different volume average particle diameters. The at least two types of silica particles comprise silica particles A having a volume average primary particle diameter of from 70 to 220 nm and silica particles B having a volume average primary particle diameter of from 15 to 50 nm, and an amount (Ma) of the silica particles A and an amount (Mb) of the silica particles B are from 1 to 4 parts by mass and from 0.5 to 3 parts by mass, respectively, based on 100 parts by mass of the toner base particles.

More preferably, the volume average primary particle diameter of the silica particles A is from 120 to 180 nm.

More preferably, the volume average primary particle diameter of the silica particles B is from 20 to 30 nm.

More preferably, the amount Ma is from 2.0 to 3.0 parts by mass.

More preferably, the amount Mb is from 1.0 to 2.0 parts by mass.

Cleaning Blade

Figure 1B:
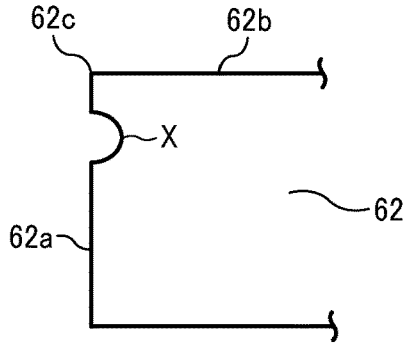
FIG. 1B is a diagram illustrating a state in which a leading end surface of a cleaning blade is locally worn.
Figure 1C:
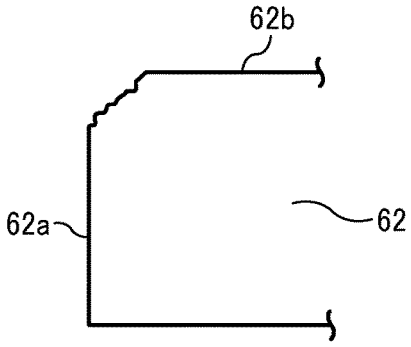
FIG. 1C is a diagram illustrating a state in which a leading end ridge part of a cleaning blade is missing.

One method of improving the cleaning performance of a cleaning blade (hereinafter may be simply referred to as "blade") involves increasing the contact pressure between the image bearer and the cleaning blade. However, when the contact pressure of the cleaning blade is increased, as illustrated in FIG. 1A, the frictional force between an image bearer 123 and a cleaning blade 62 increases, and the cleaning blade 62 is pulled in the direction of movement of the image bearer 123. As a result, a leading end ridge part 62*c* of the cleaning blade 62 is turned up. If a cleaning operation is continued while the leading end ridge part 62*c* of the cleaning blade 62 is turned up, as illustrated in FIG. 1B, a local wear X occurs at a position several micrometers away from the leading end ridge part 62*c* of a blade leading end surface 62*a* of the cleaning blade 62. If the cleaning operation is further continued in such a state, the local wear becomes large, and eventually, as illustrated in FIG. 1C, the leading end ridge part 62*c* is worn out and becomes missing. If the leading end ridge part 62*c* becomes missing in this manner, the cleaning blade is not able to properly remove toner, resulting in defective cleaning. In FIGS. 1A to 1C, a reference sign 62*b* denotes a lower surface of the cleaning blade.

On the other hand, the elastic member of the cleaning blade according to an embodiment of the present invention is given a high hardness to scrape off substances (e.g., additives such as external additives) adhered to the surface of a photoconductor to prevent the occurrence of abnormal images (filming) due to adhesion of external additives or the like to the photoconductor. However, in a case in which the elasticity of the entire elastic member is low, there is a possibility that the elastic member be settled or the followability to the photoconductor be lowered just by increasing the hardness. There is also a possibility that an undesired phenomenon occurs in which the edge portion is chipped due to vibration of the elastic member or stick-slip of the edge portion. The elastic member according to an embodiment of the present invention preferably has an elastic power of from 75% to 95%. When the elastic power is 75% or more, chipping of the edge portion due to vibration and stick-slip of the edge portion can be more prevented. When the elastic power is 95% or less, turning up of the leading end ridge part of the cleaning blade can be more prevented.

The elastic member according to an embodiment of the present invention preferably has a Tan δ peak temperature of 5 degrees C. or less. The Tan δ peak temperature indicates a temperature range that guarantees the function as an elastic body. The elastic member according to an embodiment of the present invention has a function as an elastic body even in an environment at 10 degrees C. or lower. For example, even in a low-temperature and low-humidity environment, it is unlikely that a decrease of the followability to photoconductor due to loss of elasticity of the elastic member occurs, and sufficient cleaning performance is ensured.

The shape, material, size, structure, and the like of the elastic body of the elastic member are not particularly limited and can be suitably selected to suit to a particular application.

The shape may be, for example, a plate shape, a strip shape, or a sheet shape.

The size is not particularly limited and can be suitably selected according to the size of the photoconductor.

The material is not particularly limited and can be suitably selected to suit to a particular application. Preferred examples thereof include polyurethane rubber and polyurethane elastomer because they can easily achieve high elasticity.

The method for manufacturing the elastic member is not particularly limited and can be suitably selected to suit to a particular application. For example, the elastic member can be manufactured as follows. First, a polyurethane prepolymer is prepared from a polyol compound and a polyisocyanate compound, then a curing agent is added thereto, optionally along with a curing catalyst, to cause a cross-linking reaction in a predetermined mold. Next, the product is post-cross-linked in a furnace, formed into a sheet by centrifugal molding, left at room temperature for aging, and cut into a flat plate having a predetermined size.

The polyol compound is not particularly limited and can be suitably selected to suit to a particular application. Examples thereof include, but are not limited to, high-molecular-weight polyols and low-molecular-weight polyols.

Specific examples of the high-molecular-weight polyols include, but are not limited to, a polyester polyol which is a condensate of an alkylene glycol and an aliphatic diprotic acid; polyester-based polyols, such as polyester polyols of alkylene glycols with adipic acid, such as ethylene adipate ester polyol, butylene adipate ester polyol, hexylene adipate ester polyol, ethylene propylene adipate ester polyol, ethylene butylene adipate ester polyol, and ethylene neopentylene adipate ester polyol; polycaprolactone-based polyols such as polycaprolactone ester polyols obtained by ring-opening polymerization of caprolactone; and polyether-based polyols such as poly(oxytetramethylene) glycol and poly(oxypropylene) glycol. Each of these can be used alone or in combination with others.

Specific examples of the low-molecular-weight polyols include, but are not limited to, divalent alcohols such as 1,4-butanediol, ethylene glycol, neopentyl glycol, hydroquinone-bis(2-hydroxyethyl) ether, 3,3'-dichloro-4,4'-diaminodiphenylmethane, and 4,4'-diaminodiphenylmethane, and trivalent or higher polyols such as 1,1,1-trimethylolpropane, glycerin, 1,2,6-hexanetriol, 1,2,4-butanetriol, trimethylolethane, 1,1,1-tris(hydroxyethoxymethyl)propane, diglycerin, and pentaerythritol. Each of these can be used alone or in combination with others.

The polyisocyanate compound is not particularly limited and can be suitably selected to suit to a particular application. Specific examples thereof include, but are not limited to, methylene diphenyl diisocyanate (MDI), tolylene diisocyanate (TDI), xylylene diisocyanate (XDT), naphthylene 1,5-diisocyanate (NDI), tetramethylxylene diisocyanate (TMXDT), isophorone diisocyanate (IPDI), hydrogenated xylylene diisocyanate (H6XDI), dicyclohexylmethane diisocyanate (H12MDI), hexamethylene diisocyanate (HDI), dimer acid diisocyanate (DDI), norbornene diisocyanate (NBDI), and trimethylhexamethylene diisocyanate (TMDI). Each of these can be used alone or in combination with others.

The curing catalyst is not particularly limited and can be suitably selected to suit to a particular application. Examples thereof include, but are not limited to, amine compounds such as tertiary amines and organometallic compounds such as organotin compounds.

Specific examples of the tertiary amines include, but are not limited to, trialkylamines such as tri ethyl amine, tetraalkyldiamines such as N,N,N',N'-tetramethyl-1,3-butanediamine, amino alcohols such as dimethylethanolamine, ester amines such as ethoxylated amine, ethoxylated diamine, and bis(diethylethanolamine) adipate, cyclohexylamine derivatives such as triethylenediamine (TEDA) and N,N-dimethylcyclohexylamine, morpholine derivatives such as N-methylmorpholine, N-(2-hydroxypropyl)-dimethylmorpholine, and piperazine derivatives such as N,N'-diethyl-2-methylpiperazine and N,N'-bis-(2-hydroxypropyl)-2-methylpiperazine. Specific examples of the organotin compounds include, but are not limited to, dialkyltin compounds such as dibutyltin dilaurate and dibutyltin di(2-ethylhexoate), stannous 2-ethylcaproate, and stannous oleate. Each of these can be used alone or in combination with others.

The Martens hardness (HM) is measured using a nanoindentation method as follows. The Martens hardness (HM) is measured according to ISO 14577 using a nanoindenter ENT-3100 manufactured by ELIONIX INC. by pushing a Berkovich indenter into a sample with a load of 1 μN for 10 seconds, holding for 5 seconds, and pulling the indenter with the same loading rate for 10 seconds. The measurement position is 100 μm away from the leading end ridge part of the leading end surface of the elastic member of the blade. Specifically, the Martens hardness (HM) is measured using a Berkovich indenter with a load of 1 μN, and an embodiment of the present invention is achieved when the measured value is within the range of from 3 to 8 $N/mm^2$.

Figure 2:
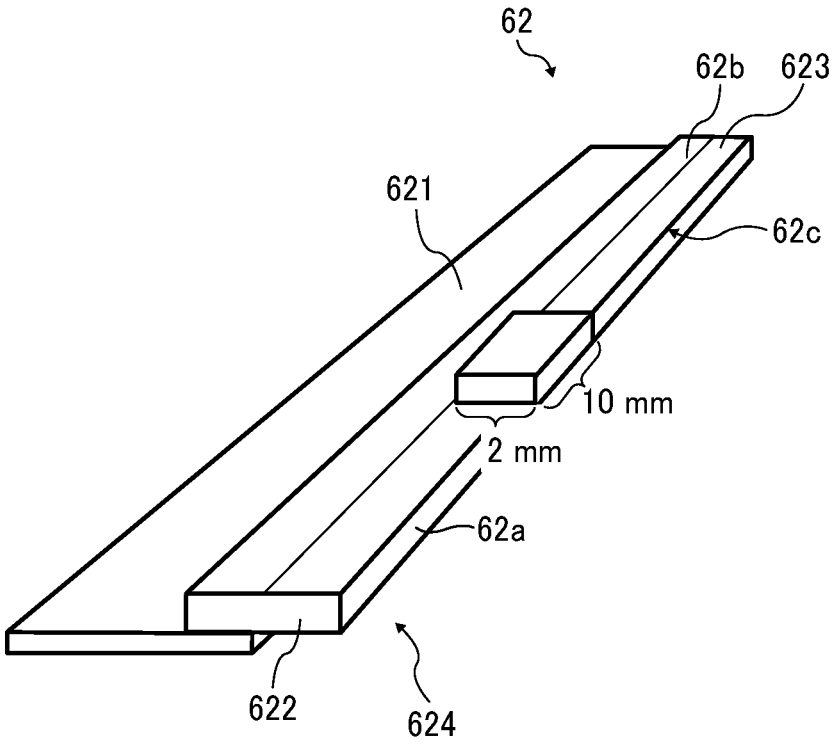
FIG. 2 is a diagram for explaining a cut portion of a substrate for measuring the Martens hardness (HM) of the substrate.
Figure 3A:
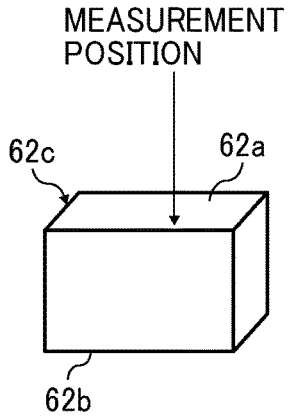
FIGS. 3A to 3C are diagrams for explaining measurement positions for the Martens hardness (HM) of the substrate.
Figure 3B:
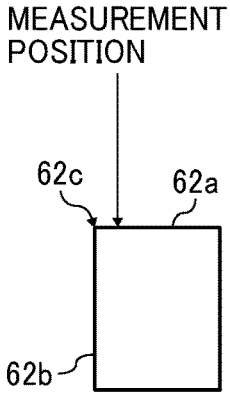
Figure 3C:
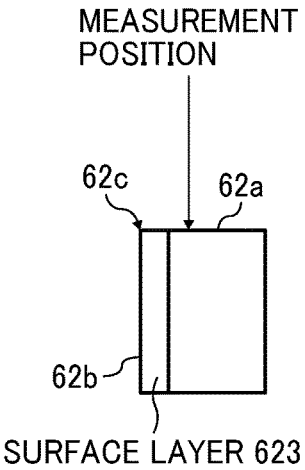

In the measurement, as illustrated in FIG. 2, an elastic member (substrate) 622 is cut out into a rectangle from a blade leading end surface 62*a* such that the rectangle has a length of 2 mm in a lateral direction of the substrate 622 (i.e., a direction orthogonal to the longitudinal direction of the substrate 622) and a length of 10 mm in the longitudinal direction. (In FIG. 2, reference numerals 621, 623, and 624 respectively denote a support, a surface layer, and an elastic member.) After that, as illustrated in a perspective view of the substrate in FIG. 3A and a front view of the substrate in FIG. 3B, the cut substrate is fixed to a slide glass with an adhesive or double-sided tape such that the blade leading end surface 62*a* faces upward. The Martens hardness (HM) is measured at a measurement position that is 100 μm away from a leading end ridge part 62*c* in the lateral direction. Even when a surface layer is formed on the lower surface of the substrate as illustrated in FIG. 3C, the Martens hardness (HM) can be measured in the same manner.

The elastic power is a characteristic value determined from the integrated stress at the time of measuring the Martens hardness as follows. The Martens hardness is measured using a microhardness tester by an operation, for example, in which a Berkovich indenter is pushed with a constant force for 30 seconds, held for 5 seconds, and pulled with a constant force for 30 seconds.

Figure 4:
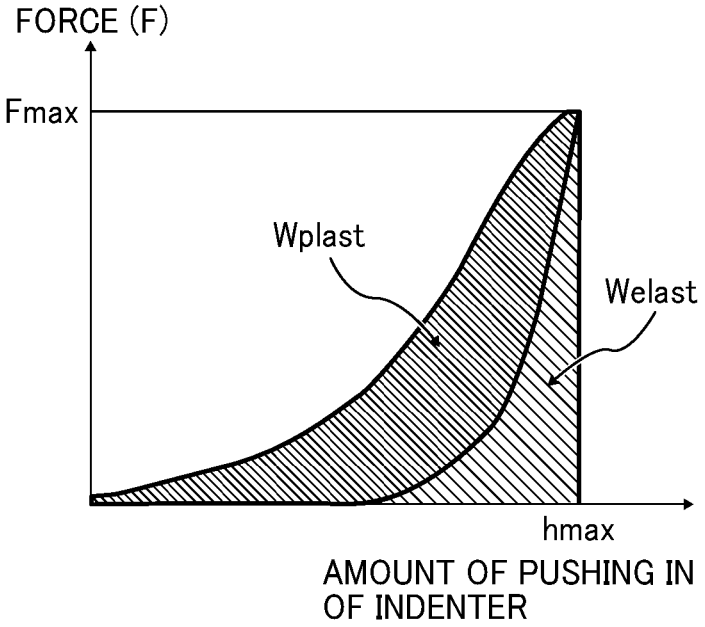
FIG. 4 is an explanatory diagram of elastic power.

Here, the elastic power is a characteristic value defined by the equation Welast/Wplast×100 [%], where Wplast is an integrated stress when the Berkovich indenter is pushed and Welast is an integrated stress when the test load is unloaded (See FIG. 4). The higher the elastic power, the less the plastic deformation, that is, the higher the rubber property. When the elastic power is from 75% to 95%, the movement of the contact part is not inhibited, and the wear resistance is improved.

Tan δ is measured using a dynamic viscoelasticity measuring device within a temperature range from 0 to 50 degrees C. Dynamic storage elastic modulus (E') and dynamic loss elastic modulus (E") are measured at a constant frequency or at multiple frequencies. Tan δ (dynamic loss tangent) of a material used for the cleaning blade, such as urethane rubber, is calculated from E'/E".

The average thickness of the elastic member is not particularly limited and can be suitably selected to suit to a particular application, but is preferably from 1.0 to 3.0 mm.

Toner

Toner Base Particles

The toner base particles contain a binder resin, a colorant, and a release agent, and may further contain other components, as necessary.

Preferably, the toner base particles are prepared by dissolving or dispersing at least a binder resin and a release agent in an organic solvent, adding the resulting solution or dispersion to an aqueous phase, and removing the organic solvent from the resulting dispersion liquid. More preferably, the toner base particles are prepared by dissolving or dispersing at least a binder resin precursor and a release agent in an organic solvent, adding the resulting solution or dispersion to an aqueous phase to subject the binder resin precursor to a cross-linking or elongation reaction, and removing the organic solvent from the resulting dispersion liquid.

The toner base particles contain a polyester, preferably a non-linear amorphous polyester A, and more preferably a crystalline polyester C.

THF-insoluble matter preferably contains the non-linear amorphous polyester A or the crystalline polyester C.

Amorphous Polyester Resin

The amorphous polyester resin can be obtained from a polyol component and a polycarboxylic acid component such as polycarboxylic acid, polycarboxylic acid anhydride, and polycarboxylic acid ester.

In the present disclosure, the amorphous polyester resin refers to a resin obtained from a polyol component and a polycarboxylic acid component such as polycarboxylic acid, polycarboxylic acid anhydride, and polycarboxylic acid ester. Modified polyester resins, such as a prepolymer (to be described later) and a resin obtained by cross-linking and/or elongating the prepolymer, do not fall within the amorphous polyester resin of the present disclosure.

Specific examples of the polyol component include, but are not limited to, alkylene (C2-C3) oxide adducts (with an average addition molar number of 1 to 10) of bisphenol A such as polyoxypropylene(2.2)-2,2-bis(4-hydroxyphenyl) propane and polyoxyethylene(2.2)-2,2-bis(4-hydroxyphenyl)propane; and ethylene glycol, propylene glycol, neopentyl glycol, glycerin, pentaerythritol, trimethylolpropane, hydrogenated bisphenol A, sorbitol, and alkylene (C2-C3) oxide adducts (with an average addition molar number of 1 to 10) of these compounds. Each of these can be used alone or in combination with others.

Specific examples of the polycarboxylic acid component include, but are not limited to, dicarboxylic acids such as adipic acid, phthalic acid, isophthalic acid, terephthalic acid, fumaric acid, and maleic acid; succinic acids substituted with an alkyl group having 1 to 20 carbon atoms or an alkenyl group having 2 to 20 carbon atoms, such as dodecenyl succinic acid and octyl succinic acid; trimellitic acid and pyromellitic acid; and anhydrides and alkyl (C1-C8) esters of the above acids. Each of these can be used alone or in combination with others.

It is preferable that the amorphous polyester resin be at least partially compatibilized with a prepolymer (to be described later) and a resin obtained by cross-linking and/or elongating the prepolymer. Such a compatibilization makes improvements in low-temperature fixability and high-temperature offset resistance. Therefore, it is preferable that polyol component and the polycarboxylic acid component constituting the amorphous polyester resin and those constituting the prepolymer be similar in composition.

The molecular weight of the amorphous polyester resin is not particularly limited and can be suitably selected to suit to a particular application. However, if the molecular weight is too low, heat-resistant storage stability and durability (i.e., resistance to stresses, such as that caused by stirring in a developing device) of the toner will deteriorate. If the molecular weight is too high, viscoelasticity of the toner at melting will increase, so that low-temperature fixability will deteriorate. Therefore, the weight average molecular weight (Mw) is preferably from 2,500 to 10,000, the number average molecular weight (Mn) is preferably from 1,000 to 4,000, and Mw/Mn is preferably from 1.0 to 4.0, when measured by GPC (gel permeation chromatography).

The acid value of the amorphous polyester resin is not particularly limited and can be suitably selected to suit to a particular application, but is preferably from 1 to 50 mgKOH/g, more preferably from 5 to 30 mgKOH/g. When the acid value is 1 mgKOH/g or higher, the toner becomes more negatively-chargeable and more compatible with paper when being fixed thereon, improving low-temperature fixability. When the acid value is 50 mgKOH/g or lower, charge stability, particularly charge stability against environmental fluctuation does not decrease.

The hydroxyl value of the amorphous polyester resin is not particularly limited and can be suitably selected to suit to a particular application, but is preferably 5 mgKOH/g or higher.

The glass transition temperature (Tg) of the amorphous polyester resin is not particularly limited and can be suitably selected to suit to a particular application. However, if Tg is too low, heat-resistant storage stability and durability (i.e., resistance to stresses, such as that caused by stirring in a developing device) of the toner will deteriorate. If Tg is too high, viscoelasticity of the toner at melting will increase, so that low-temperature fixability will deteriorate. Therefore, Tg is preferably from 40 to 70 degrees C., more preferably from 45 to 60 degrees C.

The content of the amorphous polyester resin in the toner is not particularly limited and can be suitably selected to suit to a particular application, but is preferably from 50 to 95 parts by mass, more preferably from 60 to 90 parts by mass, in 100 parts by mass of the toner. When the content is less than 50 parts by mass, dispersibility of colorants and release agents in the toner may be poor, and image fog or disturbance may be caused. When the content is greater than 95 parts by mass, the amount of the crystalline polyester resin is so small that low-temperature fixability may be poor. When the content is within the preferred range, high image quality, high stability, and low-temperature fixability are all advantageously achieved.

The molecular structure of the amorphous polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect an amorphous polyester resin as a substance showing no absorption peak based on δCH (out-of-plane bending vibration) of olefin at 965±10 $cm^{-1}$ and 990±10 $cm^{-1}$ in an infrared absorption spectrum.

Crystalline Polyester Resin

The crystalline polyester resin has a structural unit derived from a saturated aliphatic diol.

Preferred examples of the saturated aliphatic diol include an alcohol component containing a straight-chain aliphatic diol having 2 to 8 carbon atoms.

Such a crystalline polyester resin can be finely and uniformly dispersed inside the toner. As a result, filming of the crystalline polyester resin is prevented, stress resistance of the toner is improved, and low-temperature fixability of the toner is achieved.

The crystalline polyester resin has a heat melting property such that the viscosity rapidly decreases at around the fixing start temperature due to its high crystallinity. By containing the crystalline polyester resin having such a property, the toner maintains good storage stability below the melting start temperature due to the crystallinity of the crystalline polyester resin and undergoes a rapid decrease in viscosity ("sharply-melting property") at the melting start temperature for fixing. Thus, the toner exhibits excellent heat-resistant storage stability and low-temperature fixability. Such a toner also exhibits a wide releasable range (i.e., the difference between the lower-limit fixable temperature and the hot offset generating temperature).

The crystalline polyester resin can be obtained from a polyol component and a polycarboxylic acid component such as polycarboxylic acid, polycarboxylic acid anhydride, and polycarboxylic acid ester.

In the present disclosure, the crystalline polyester resin refers to a resin obtained from a polyol component and a polycarboxylic acid component such as polycarboxylic acid, polycarboxylic acid anhydride, and polycarboxylic acid ester. Modified crystalline polyester resins, such as a prepolymer (to be described later) and a resin obtained by cross-linking and/or elongating the prepolymer, do not fall within the crystalline polyester resin of the present disclosure.

Polyol Component

The polyol component is not particularly limited and can be suitably selected to suit to a particular application. Examples thereof include, but are not limited to, diols and trivalent or higher alcohols.

Examples of the diols include, but are not limited to, saturated aliphatic diols. Examples of the saturated aliphatic diols include, but are not limited to, straight-chain saturated aliphatic diols and branched saturated aliphatic diols. In particular, straight-chain saturated aliphatic diols are preferred, and straight-chain saturated aliphatic diols having 2 to 8 carbon atoms are more preferred. The branched saturated aliphatic diols may lower crystallinity of the crystalline polyester resin and may further lower the melting point thereof. When the number of carbon atoms in the main chain is less than 2, the melting temperature becomes high in the case of polycondensation with an aromatic dicarboxylic acid, and it may be difficult to fix the toner at low temperatures. Those containing more than 8 carbon atoms are not easily available. Thus, the number of carbon atoms is preferably 8 or less.

Specific examples of the saturated aliphatic diols include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these, ethylene glycol, 1,3-propanediol, 1,4-butanediol, 1,5-pentanediol, and 1,6-hexanediol are preferred for the crystalline polyester resin having high crystallinity and sharply-melting property.

Specific examples of the trivalent or higher alcohols include, but are not limited to, glycerin, trimethylolethane, trimethylolpropane, and pentaerythritol.

Each of these may be used alone or in combination with others.

Polycarboxylic Acid Component

As the polycarboxylic acid, sebacic acid is used. Other divalent carboxylic acids and trivalent or higher carboxylic acids may be used in combination according to a particular application.

Specific examples of the divalent carboxylic acids include, but are not limited to: saturated aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as diprotic acids such as phthalic acid, isophthalic acid, terephthalic acid, naphthalene-2,6-dicarboxylic acid, malonic acid, and mesaconic acid; and anhydrides and lower alkyl esters thereof.

Specific examples of the trivalent or higher carboxylic acids include, but are not limited to, 1,2,4-benzenetricarboxylic acid, 1,2,5-benzenetricarboxylic acid, 1,2,4-naphthalenetricarboxylic acid, and anhydrides and lower alkyl esters thereof.

The polycarboxylic acid component may further include a dicarboxylic acid component having sulfo group, other than the above-described saturated aliphatic dicarboxylic acids and aromatic dicarboxylic acids. In addition, the polycarboxylic acid component may further include a dicarboxylic acid having a double bond, other than the above-described saturated aliphatic dicarboxylic acids and aromatic dicarboxylic acids.

Each of these may be used alone or in combination with others.

The melting point of the crystalline polyester resin is not particularly limited and can be suitably selected to suit to a particular application, but is preferably 60 degrees C. or higher and less than 80 degrees C. When the melting point is 60 degrees C. or higher, the crystalline polyester resin is prevented from melting at low temperatures, improving heat-resistant storage stability of the toner. When the melting point is lower than 80 degrees C., the polyester resin A sufficiently melts when heated at the time of fixing, improving low-temperature fixability.

The melting point can be determined from an endothermic peak value in a DSC chart measured by differential scanning calorimetry (DSC).

The molecular weight of the crystalline polyester resin is not particularly limited and can be suitably selected to suit to a particular application. As the molecular weight distribution becomes narrower and the molecular weight becomes lower, low-temperature fixability improves. As the amount of low-molecular-weight components increases, heat-resistant storage stability deteriorates. In view of this, preferably, ortho-dichlorobenzene-soluble matter in the crystalline polyester resin has a weight average molecular weight (Mw) of from 3,000 to 30,000, a number average molecular weight (Mn) of from 1,000 to 10,000, and a ratio Mw/Mn of from 1.0 to 10, when measured by GPC (gel permeation chromatography).

The acid value of the crystalline polyester resin is not particularly limited and can be suitably selected to suit to a particular application, but is preferably 5 mgKOH/g or more, more preferably 10 mgKOH/g or more, for achieving a desired level of low-temperature fixability in terms of affinity for paper. On the other hand, for improving high-temperature offset resistance, the acid value is preferably 45 mgKOH/g or less.

The hydroxyl value of the crystalline polyester resin is not particularly limited and can be suitably selected to suit to a particular application, but is preferably from 0 to 50 mgKOH/g, more preferably from 5 to 50 mgKOH/g, for achieving a desired level of low-temperature fixability and a good level of chargeability.

The molecular structure of the crystalline polyester resin can be determined by, for example, solution or solid NMR (nuclear magnetic resonance), X-ray diffractometry, GC/MS (gas chromatography-mass spectroscopy), LC/MS (liquid chromatography-mass spectroscopy), or IR (infrared spectroscopy). For example, IR can simply detect a crystalline polyester resin as a substance showing an absorption peak based on δCH (out-of-plane bending vibration) of olefin at $965\pm10\ cm^{-1}$ or $990\pm10\ cm^{-1}$ in an infrared absorption spectrum.

The content of the crystalline polyester resin in the toner is not particularly limited and can be suitably selected to suit to a particular application, but is preferably from 2 to 20 parts by mass, more preferably from 5 to 15 parts by mass, in 100 parts by mass of the toner. When the content is 2 parts by mass or more, sharply-melting property of the crystalline polyester resin is sufficient, and low-temperature fixability is improved. When the content is parts by mass or less, heat-resistant storage stability is improved, and image fog is prevented. When the content is within the preferred range, high image quality, high stability, and low-temperature fixability are all advantageously achieved.

Other Components

The other components contained in the toner are not particularly limited and can be suitably selected to suit to a particular application. Examples thereof include, but are not limited to, a release agent, a colorant, a polymer having a site reactive with an active-hydrogen-group-containing compound, an active-hydrogen-group-containing compound, a charge controlling agent, a fluidity improving agent, a cleanability improving agent, and a magnetic material.

Release Agent

The release agent is not particularly limited and may be appropriately selected from known materials.

Specific examples of the release agent include, but are not limited to, waxes, particularly natural waxes such as plant waxes (e.g., carnauba wax, cotton wax, sumac wax, rice wax), animal waxes (e.g., beeswax, lanolin), mineral waxes (e.g., ozokerite, ceresin), and petroleum waxes (e.g., paraffin wax, microcrystalline wax, petrolatum wax).

Specific examples of the release agent further include, but are not limited to, synthetic hydrocarbon waxes (e.g., Fischer-Tropsch wax, polyethylene, polypropylene) and synthetic waxes (e.g., ester, ketone, ether).

Furthermore, the following materials may also be used: fatty acid amide compounds such as 12-hydroxystearic acid amide, stearic acid amide, phthalic anhydride imide, and chlorinated hydrocarbon; homopolymers and copolymers of polyacrylates (e.g., poly-n-stearyl methacrylate, poly-n-lauryl methacrylate), which are low-molecular-weight crystalline polymers, such as copolymer of n-stearyl acrylate and ethyl methacrylate; and crystalline polymers having a long alkyl group on a side chain.

Among these materials, hydrocarbon waxes such as paraffin wax, micro-crystalline wax, Fischer-Tropsch wax, polyethylene wax, and polypropylene wax are preferred.

The melting point of the release agent is not particularly limited and can be suitably selected to suit to a particular application, but is preferably 60 degrees C. or higher and lower than 95 degrees C.

More preferably, the release agent is a hydrocarbon wax having a melting point of 60 degrees C. or higher and lower than 95 degrees C. Such a release agent can effectively act at the interface between a fixing roller and the toner, thereby improving high-temperature offset resistance without applying another release agent such as an oil to the fixing roller.

In particular, hydrocarbon waxes are preferred because they have almost no compatibility with the polyester resin A and able to function independently from each other. Therefore, either the softening effect of the crystalline polyester resin as a binder resin or the offset property of the release agent is not impaired.

When the melting point is 60 degrees C. or higher, the release agent is prevented from melting at low temperatures, improving heat-resistant storage stability of the toner. When the melting point of the release agent is lower than 95 degrees C., the release agent sufficiently melts by heating at the time of fixing, providing sufficient offset property.

The content of the release agent in the toner is not particularly limited and can be suitably selected to suit to a particular application, but is preferably from 2 to 10 parts by mass, more preferably from 3 to 8 parts by mass, in 100 parts by mass of the toner. When the content is 2 parts by mass or more, high-temperature offset resistance at the time of fixing and low-temperature fixability are good. When the content is 10 parts by mass or less, heat-resistant storage stability is improved, and image fog is prevented. When the content is within the preferred range, image quality and fixing stability are advantageously improved.

Colorant

The colorant is not particularly limited and can be suitably selected to suit to a particular application. Specific examples thereof include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perinone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone.

The content of the colorant in the toner is not particularly limited and can be suitably selected to suit to a particular application, but is preferably from 1 to 15 parts by mass, more preferably from 3 to 10 parts by mass, in 100 parts by mass of the toner.

The colorant can be combined with a resin to be used as a master batch. Examples of the resin to be used for manufacturing the master batch or kneaded with the master batch include, but are not limited to: hybrid resins, and polymers of styrene or substitutes thereof, such as polystyrene, poly p-chlorostyrene, and polyvinyl toluene; styrene-based copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Each of these can be used alone or in combination with others.

The master batch can be obtained by mixing and kneading the resin and the colorant while applying a high shearing force thereto. To increase the interaction between the colorant and the resin, an organic solvent may be used. More specifically, the maser batch can be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. Preferably, the mixing and kneading is performed by a high shearing dispersing device such as a three roll mill.

Polymer Having Site Reactive with Active-hydrogen-group-containing Compound (Prepolymer)

The polymer having a site reactive with an active-hydrogen-group-containing compound (hereinafter "prepolymer") is not particularly limited and can be suitably selected to suit to a particular application. Specific examples thereof include, but are not limited to, polyol resins, polyacrylic resins, polyester resins, epoxy resins, and derivatives thereof. Each of these can be used alone or in combination with others.

Among these, polyester resins are preferred for their high flowability at the time of melting and transparency.

Specific examples of the site reactive with an active-hydrogen-group-containing compound contained in the prepolymer include, but are not limited to, isocyanate group, epoxy group, carboxyl group, and a functional group represented by the chemical formula —COCl. Each of these can be used alone or in combination with others.

Among these, isocyanate group is preferred.

The prepolymer is not particularly limited and can be suitably selected to suit to a particular application. In particular, a polyester resin capable of forming urea bonds, such as that having an isocyanate group, is preferred because the molecular weight of high-molecular-weight components thereof is easily adjustable and such a resin is capable of providing excellent separability and oilless low-temperature fixability even in a fixing system equipped with no oil applicator for applying oil to a heat-fixing member.

Active-Hydrogen-Group-Containing Compound

The active-hydrogen-group-containing compound acts as an elongating agent or a cross-linking agent when the polymer having a site reactive with an active-hydrogen-group-containing compound undergoes an elongation reaction or a cross-linking reaction in an aqueous medium.

The active hydrogen group is not particularly limited and can be suitably selected to suit to a particular application. Examples thereof include, but are not limited to, hydroxyl group (e.g., alcoholic hydroxyl group, phenolic hydroxyl group), amino group, carboxyl group, and mercapto group. Each of these can be used alone or in combination with others.

The active-hydrogen-group-containing compound is not particularly limited and can be suitably selected to suit to a particular application. In a case in which the polymer having a site reactive with an active-hydrogen-group-containing compound is a polyester resin having an isocyanate group, an amine is preferably used as the active-hydrogen-group-containing compound because the amine is capable of making the molecular weight of the polyester resin higher through an elongation reaction or a cross-linking reaction. The amine is not particularly limited and can be suitably selected to suit to a particular application. Specific examples thereof include, but are not limited to, diamines, trivalent or higher amines, amino alcohols, amino mercaptans, amino acids, and blocked amines in which the amino group in any of these is blocked. Each of these can be used alone or in combination with others.

Among these, a diamine alone and a mixture of a diamine with a small amount of a trivalent or higher amine are preferred.

The diamines are not particularly limited and can be suitably selected to suit to a particular application. Examples thereof include, but are not limited to, aromatic diamines, alicyclic diamines, and aliphatic diamines. The aromatic diamines are not particularly limited and can be suitably selected to suit to a particular application. Examples thereof include, but are not limited to, phenylenediamine, diethyltoluenediamine, and 4,4'-diaminodiphenylmethane. The alicyclic diamines are not particularly limited and can be suitably selected to suit to a particular application. Examples thereof include, but are not limited to, 4,4'-diamino-3,3'-dimethyldicyclohexylmethane, diaminocyclohexane, and isophoronediamine. The aliphatic diamines are not particularly limited and can be suitably selected to suit to a particular application. Examples thereof include, but are not limited to, ethylenediamine, tetramethylenediamine, and hexamethylenediamine.

The trivalent or higher amines are not particularly limited and can be suitably selected to suit to a particular application. Examples thereof include, but are not limited to, diethylenetriamine and triethylenetetramine.

The amino alcohols are not particularly limited and can be suitably selected to suit to a particular application. Examples thereof include, but are not limited to, ethanolamine and hydroxyethylaniline.

The amino mercaptans are not particularly limited and can be suitably selected to suit to a particular application. Examples thereof include, but are not limited to, aminoethyl mercaptan and aminopropyl mercaptan.

The amino acids are not particularly limited and can be suitably selected to suit to a particular application. Examples thereof include, but are not limited to, aminopropionic acid and aminocaproic acid.

The amines in which the amino group is blocked are not particularly limited and can be suitably selected to suit to a particular application. Examples thereof include, but are not limited to, ketimine compounds obtained by blocking the amino group with a ketone such as acetone, methyl ethyl ketone, and methyl isobutyl ketone, and oxazoline compounds.

Polyester Resin Having Isocyanate Group

The polyester resin having an isocyanate group (hereinafter may be referred to as the "polyester prepolymer having an isocyanate group") is not particularly limited and can be suitably selected to suit to a particular application. Examples thereof include, but are not limited to, a reaction product of a polyisocyanate with a polyester resin having an active hydrogen group which is obtained by a polycondensation between a polyol and a polycarboxylic acid.

Polyol

The polyol is not particularly limited and can be suitably selected to suit to a particular application. Examples thereof include, but are not limited to, diols, trivalent or higher alcohols, and mixtures of diols with trivalent or higher alcohols. Each of these can be used alone or in combination with others.

Among these, a diol alone and a mixture of a diol with a small amount of a trivalent or higher alcohol are preferred.

The diols are not particularly limited and can be suitably selected to suit to a particular application. Specific examples thereof include, but are not limited to, alkylene glycols (e.g., ethylene glycol, 1,2-propylene glycol, 1,3-propylene glycol, 1,4-butanediol, 1,6-hexanediol); diols having an oxyalkylene group (e.g., diethylene glycol, triethylene glycol, dipropylene glycol, polyethylene glycol, polypropylene glycol, polytetramethylene glycol); alicyclic diols (e.g., 1,4-cyclohexanedimethanol, hydrogenated bisphenol A); alicyclic diols to which an alkylene oxide, such as ethylene oxide, propylene oxide, or butylene oxide, is adducted; bisphenols (e.g., bisphenol A, bisphenol F, bisphenol S); and bisphenols to which an alkylene oxide, such as ethylene oxide, propylene oxide, or butylene oxide, is adducted. The number of carbon atoms in the alkylene glycols is not particularly limited and can be suitably selected to suit to a particular application, but is preferably from 2 to 12.

Among these, alkylene glycols having 2 to 12 carbon atoms, and alkylene oxide adducts of bisphenols are preferred; and alkylene oxide adducts of bisphenols, and mixtures of alkylene oxide adducts of bisphenols with alkylene glycols having 2 to 12 carbon atoms are more preferred.

The trivalent or higher alcohols are not particularly limited and can be suitably selected to suit to a particular application. Examples thereof include, but are not limited to, trivalent or higher aliphatic alcohols, trivalent or higher polyphenols, and alkylene oxide adducts of trivalent or higher polyphenols.

The trivalent or higher aliphatic alcohols are not particularly limited and can be suitably selected to suit to a particular application. Specific examples thereof include, but are not limited to, glycerin, trimethylolethane, trimethylolpropane, pentaerythritol, and sorbitol.

The trivalent or higher polyphenols are not particularly limited and can be suitably selected to suit to a particular application. Specific examples thereof include, but are not limited to, trisphenol PA, phenol novolac, and cresol novolac.

Specific examples of the alkylene oxide adducts of trivalent or higher polyphenols include, but are not limited to, alkylene oxide (e.g., ethylene oxide, propylene oxide, and butylene oxide) adducts of trivalent or higher polyphenols.

In a case in which the diol and the trivalent or higher alcohol are used in combination, the mass ratio of the trivalent or higher alcohol to the diol is not particularly limited and can be suitably selected to suit to a particular application, but is preferably from 0.01% to 10% by mass, and more preferably from 0.01% to 1% by mass.

Polycarboxylic Acid

The polycarboxylic acid is not particularly limited and can be suitably selected to suit to a particular application. Examples thereof include, but are not limited to, dicarboxylic acids, trivalent or higher carboxylic acids, and mixtures of dicarboxylic acids with trivalent or higher carboxylic acids. Each of these can be used alone or in combination with others.

Among these, a dicarboxylic acid alone and a mixture of a dicarboxylic acid with a small amount of a trivalent or higher polycarboxylic acid are preferred.

The dicarboxylic acids are not particularly limited and can be suitably selected to suit to a particular application. Specific examples thereof include, but are not limited to, divalent alkanoic acids, divalent alkenoic acids, and aromatic dicarboxylic acids.

The divalent alkanoic acids are not particularly limited and can be suitably selected to suit to a particular application. Specific examples thereof include, but are not limited to, succinic acid, adipic acid, and sebacic acid.

The divalent alkenoic acids are not particularly limited and can be suitably selected to suit to a particular application. Specific preferred examples thereof include, but are not limited to, divalent alkenoic acids having 4 to 20 carbon atoms. The divalent alkenoic acids having 4 to 20 carbon atoms are not particularly limited and can be suitably selected to suit to a particular application. Specific examples thereof include, but are not limited to, maleic acid and fumaric acid.

The aromatic dicarboxylic acids are not particularly limited and can be suitably selected to suit to a particular application. Specific preferred examples thereof include, but are not limited to, aromatic dicarboxylic acids having 8 to 20 carbon atoms. The aromatic dicarboxylic acids having 8 to 20 carbon atoms are not particularly limited and can be suitably selected to suit to a particular application. Specific examples thereof include, but are not limited to, phthalic acid, isophthalic acid, terephthalic acid, and naphthalenedicarboxylic acid.

The trivalent or higher carboxylic acids are not particularly limited and can be suitably selected to suit to a particular application. Examples thereof include, but are not limited to, trivalent or higher aromatic carboxylic acids.

The trivalent or higher aromatic carboxylic acids are not particularly limited and can be suitably selected to suit to a particular application. Specific preferred examples thereof include, but are not limited to, trivalent or higher aromatic carboxylic acids having 9 to 20 carbon atoms. The trivalent or higher aromatic carboxylic acids having 9 to 20 carbon atoms are not particularly limited and can be suitably selected to suit to a particular application. Specific examples thereof include, but are not limited to, trimellitic acid and pyromellitic acid.

Examples of the polycarboxylic acid further include acid anhydrides and lower alkyl esters of the dicarboxylic acids, the trivalent or higher carboxylic acids, and mixtures of the dicarboxylic acids with the trivalent or higher carboxylic acids.

The lower alkyl esters are not particularly limited and can be suitably selected to suit to a particular application. Specific examples thereof include, but are not limited to, methyl ester, ethyl ester, and isopropyl ester.

In a case in which the dicarboxylic acid and the trivalent or higher carboxylic acid are used in combination, the mass ratio of the trivalent or higher carboxylic acid to the dicarboxylic acid is not particularly limited and can be suitably selected to suit to a particular application, but is preferably from 0.01% to 10% by mass, and more preferably from 0.01% to 1% by mass.

At a polycondensation between the polyol and the polycarboxylic acid, the equivalent ratio of hydroxyl groups in the polyol to carboxyl groups in the polycarboxylic acid is not particularly limited and can be suitably selected to suit to a particular application, but is preferably from 1 to 2, more preferably from 1 to 1.5, and particularly preferably from 1.02 to 1.3.

The content of polyol-derived structural units in the polyester prepolymer having an isocyanate group is not particularly limited and can be suitably selected to suit to a particular application, but is preferably from 0.5% to 40% by mass, more preferably from 1% to 30% by mass, and particularly preferably from 2% to 20% by mass.

When the content is 0.5% by mass or more, high-temperature offset resistance is improved, and the toner can achieve heat-resistant storage stability and low-temperature fixability at the same time. When the content is 40% by mass or less, low-temperature fixability is improved.

Polyisocyanate

The polyisocyanate is not particularly limited and can be suitably selected to suit to a particular application. Examples thereof include, but are not limited to, aliphatic diisocyanates, alicyclic diisocyanates, aromatic diisocyanates, araliphatic diisocyanates, isocyanurates, and any of these polyisocyanates which is blocked with a phenol derivative, an oxime, or a caprolactam.

The aliphatic diisocyanates are not particularly limited and can be suitably selected to suit to a particular application. Specific examples thereof include, but are not limited to, tetramethylene diisocyanate, hexamethylene diisocyanate, methyl 2,6-diisocyanatocaproate, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanates are not particularly limited and can be suitably selected to suit to a particular application. Specific examples thereof include, but are not limited to, isophorone diisocyanate and cyclohexylmethane diisocyanate.

The aromatic diisocyanates are not particularly limited and can be suitably selected to suit to a particular application. Specific examples thereof include, but are not limited to, tolylene diisocyanate, diisocyanatodiphenylmethane, 1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The araliphatic diisocyanates are not particularly limited and can be suitably selected to suit to a particular application. Specific examples thereof include, but are not limited to, $\alpha,\alpha,\alpha',\alpha'$-tetramethylxylylene diisocyanate.

The isocyanurates are not particularly limited and can be suitably selected to suit to a particular application. Specific examples thereof include, but are not limited to, tris(isocyanatoalkyl) isocyanurate and tris(isocyanatocycloalkyl) isocyanurate. Each of these can be used alone or in combination with others.

In a case in which the polyisocyanate is reacted with a polyester resin having a hydroxyl group, the equivalent ratio of isocyanate groups in the polyisocyanate to hydroxyl groups in the polyester resin is not particularly limited and can be suitably selected to suit to a particular application, but is preferably from 1 to 5, more preferably from 1.2 to 4, and particularly preferably from 1.5 to 3. When the equivalent ratio is 1 or more, offset resistance is improved. When the equivalent ratio is 5 or less, low-temperature fixability is improved.

The content of polyisocyanate-derived structural units in the polyester prepolymer having an isocyanate group is not particularly limited and can be suitably selected to suit to a particular application, but is preferably from 0.5% to 40% by mass, more preferably from 1% to 30% by mass, and particularly preferably from 2% to 20% by mass. When the content is 0.5% by mass or more, high-temperature offset resistance is improved. When the content is 40% by mass or less, low-temperature fixability is improved.

The average number of isocyanate groups included in one molecule of the polyester prepolymer having an isocyanate group is not particularly limited and can be suitably selected to suit to a particular application, but is preferably 1 or more, more preferably from 1.2 to 5, and particularly preferably from 1.5 to 4. When the average number is 1 or more, the molecular weight of the urea-modified polyester resin becomes higher and high-temperature offset resistance is improved.

The mass ratio of the polyester prepolymer having an isocyanate group to a polyester resin containing 50% by mol or more of propylene oxide adducts of bisphenols in the polyol component and having specific hydroxyl and acid values is not particularly limited and can be suitably selected to suit to a particular application, but is preferably from {(less than 5)/(more than 95)} to {(more than 25)/(less than 75)}, and more preferably from 10/90 to 25/75. When the mass ratio is from {(less than 5)/(more than 95)} to {(more than 25)/(less than 75)}, high-temperature offset resistance is improved, and low-temperature fixability and image glossiness are also improved.

Charge Controlling Agent

The charge controlling agent is not particularly limited and can be suitably selected to suit to a particular application. Examples thereof include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkyl amides, phosphorus and phosphorus-containing compounds, tungsten and tungsten-containing compounds, fluorine activators, metal salts of salicylic acid, and metal salts of salicylic acid derivatives. Specific examples thereof include, but are not limited to: BONTRON 03 (nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), available from Orient Chemical Industries Co., Ltd.; TP-302 and TP-415 (molybdenum complexes of quaternary ammonium salts), available from Hodogaya Chemical Co., Ltd.; LRA-901, and LR-147 (boron complex), available from Japan Carlit Co., Ltd.; and cooper phthalocyanine, perylene, quinacridone, azo pigments, and polymeric compounds having a functional group such as a sulfo group, a carboxyl group, and a quaternary ammonium group.

The content of the charge controlling agent in the toner is not particularly limited and can be suitably selected to suit to a particular application, but is preferably from 0.1 to 10 parts by mass, more preferably from 0.2 to 5 parts by mass, in 100 parts by mass of the toner. When the content is 10 parts by mass or less, the chargeability of the toner is not so large that the main effect of the charge controlling agent is not reduced. Therefore, deterioration of developer fluidity and image density due to the electrostatic force between the toner and the developing roller can be prevented. The charge controlling agent may be melt-kneaded with the master batch or the binder resin and thereafter dissolved or dispersed in an organic solvent, or directly dissolved or dispersed in an organic solvent. Alternatively, the charge controlling agent may be fixed on the surface of the resulting toner particles.

Fluidity Improving Agent

The fluidity improving agent is not particularly limited and can be suitably selected to suit to a particular application as long as it reforms a surface to improve hydrophobicity to prevent deterioration of fluidity and chargeability even under high-humidity environments. Specific examples thereof include, but are not limited to, silane coupling agents, silylation agents, silane coupling agents having a fluorinated alkyl group, organic titanate coupling agents, aluminum coupling agents, silicone oils, and modified silicone oils. Preferably, the above-described silica and titanium oxide are surface-treated with such a fluidity improving agent to become hydrophobic silica and hydrophobic titanium oxide, respectively.

Cleanability Improving Agent

The cleanability improving agent is not particularly limited and can be suitably selected to suit to a particular application as long as it is an additive that facilitates easy removal of the developer (toner) remaining on a photoconductor or primary transfer medium after image transfer. Specific examples thereof include, but are not limited to, metal salts of fatty acids (e.g., zinc stearate and calcium stearate) and fine particles of polymers prepared by soap-free emulsion polymerization (e.g., polymethyl methacrylate and polystyrene). Preferably, the particle size distribution of the fine particles of polymers is as narrow as possible. More preferably, the volume average particle diameter thereof is in the range of from 0.01 to 1 μm.

Magnetic Material

The magnetic material is not particularly limited and can be suitably selected to suit to a particular application. Examples thereof include, but are not limited to, iron powder, magnetite, and ferrite. In particular, those having white color tone are preferred.

The acid value of the toner is not particularly limited and can be suitably selected to suit to a particular application, but is preferably from 0.5 to 40 mgKOH/g for controlling low-temperature fixability (lower-limit fixable temperature) and the hot offset generating temperature. When the acid value is 0.5 mgKOH/g or more, it is likely that the effect of a base for improving dispersion stability is exerted during the production process. In addition, when the prepolymer is used, an elongation reaction and/or a cross-linking reaction is properly performed and the production stability is improved. When the acid value is 40 mgKOH/g or less, when the prepolymer is used, an elongation reaction and/or a cross-linking reaction is sufficiently performed, improving high-temperature offset resistance.

The glass transition temperature (Tg) of the toner is not particularly limited and can be suitably selected to suit to a particular application. However, a glass transition temperature (Tg1st) that is determined at the first temperature rise in a DSC (differential scanning calorimetry) measurement is preferably 45 degrees C. or higher and lower than 65 degrees C., and more preferably 50 degrees C. or higher and 60 degrees C. or lower. In this case, low-temperature fixability, heat-resistant storage stability, and high durability are achieved. When Tg1st is 45 degrees C. or higher, the occurrence of blocking in a developing device and filming on a photoconductor can be prevented. When Tg1st is lower than 65 degrees C., low-temperature fixability is improved.

A glass transition temperature (Tg2nd) that is determined at the second temperature rise in a DSC measurement is preferably from 20 degrees C. or higher and lower than 40 degrees C. When Tg2nd is 20 degrees C. or higher, the occurrence of blocking in a developing device and filming on a photoconductor can be prevented. When Tg2nd is lower than 40 degrees C., low-temperature fixability is improved.

The volume average particle diameter of the toner is not particularly limited and can be suitably selected to suit to a particular application, but is preferably from 3 to 7 μm. In addition, preferably, the ratio of the volume average particle diameter to the number average particle diameter is 1.2 or less. Furthermore, a proportion of toner particles having a volume-based particle diameter of 2 μm or less is preferably from 1% to 10% by number.

Measurement Method of Hydroxyl Value and Acid Value

The hydroxyl value can be measured based on a method according to JIS K0070-1966 as follows.

First, 0.5 g of a sample is precisely weighed in a 100-mL volumetric flask, and 5 mL of an acetylating agent is further put in the flask. After being heated in a hot bath at 100±5 degrees C. for 1 to 2 hours, the flask is taken out from the hot bath and let stand to cool. Water is further poured in the flask, and the flask is shaken to decompose acetic anhydride. To completely decompose acetic anhydride, the flask is reheated in the hot bath for 10 minutes or more and thereafter let stand to cool. The wall of the flask is sufficiently washed with an organic solvent.

The hydroxyl value is measured using an automatic potentiometric titrator DL-53 TITRATOR and electrodes DG113-SC (both manufactured by Mettler-Toledo International Inc.) at 23 degrees C., and an analysis is performed using an analysis software program LabX Light Version 1.00.000. The calibration of the instrument is performed with a mixed solvent of 120 mL of toluene and 30 mL of ethanol under the following condition.

[Measurement Conditions]
Stir
Speed [%] 25
Time [s] 15
EQP titration
Titrant/Sensor
Titrant CH3 ONa
Concentration [mol/L] 0.1
Sensor DG115
Unit of measurement mV
Predispensing to volume
Volume [mL] 1.0
Wait time [s] 0
Titrant addition Dynamic
dE(set) [mV] 8.0
dV(min) [mL] 0.03
dV(max) [mL] 0.5
Measure mode Equilibrium controlled
dE [mV] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
comb. termination conditions No
Evaluation
Procedure Standard
Potential1 No
Potential2 No
Stop for reevaluation No The acid value can be measured based on a method according to JIS K0070-1992 as follows.

First, 0.5 g of a sample (or 0.3 g of ethyl-acetate-soluble matter in the sample) is added to 120 mL of toluene and stirred at 23 degrees C. for about 10 hours to be dissolved in the toluene. Further, 30 mL of ethanol is added thereto, thus preparing a sample solution. In a case in which the sample cannot be dissolved, another solvent such as dioxane and tetrahydrofuran is used. The acid value is measured using an automatic potentiometric titrator DL-53 TITRATOR and electrodes DG113-SC (both manufactured by Mettler-Toledo International Inc.) at 23 degrees C., and an analysis is performed using an analysis software program LabX Light Version 1.00.000. The calibration of the instrument is performed with a mixed solvent of 120 mL of toluene and 30 mL of ethanol under the above-described conditions for measuring hydroxyl value.

More specifically, the sample solution is titrated with a 0.1N potassium hydroxide/alcohol solution, and the acid value is calculated from the following formula: Acid Value (mgKOH/g)=Titration Amount (mL)×N×56.1 (mg/mL)/Sample Mass (g), where N represents the factor of the 0.1N potassium hydroxide/alcohol solution.

Measurement Method of Melting Point and Glass Transition Temperature (Tg)

The melting point and glass transition temperature (Tg) can be measured using a DSC (differential scanning calorimeter) system (DSC-60 manufactured by Shimadzu Corporation).

More specifically, the melting point and glass transition temperature of a sample can be measured in the following manner.

First, about 5.0 mg of a sample is put in an aluminum sample container. The sample container is put on a holder unit and set in an electric furnace. The temperature is raised from 0 degrees C. to 150 degrees C. at a temperature rising rate of 10 degrees C./min in nitrogen atmosphere. The sample is then cooled from 150 degrees C. to 0 degrees C. at a temperature falling rate of 10 degrees C./min and reheating to 150 degrees C. at a temperature rising rate of 10 degrees C./min to obtain a DSC curve using a differential scanning calorimeter (DSC-60 manufactured by Shimadzu Corporation).

A glass transition temperature of the sample in the first temperature rising is determined by analyzing the DSC curve obtained in the first temperature rising using an analysis program "Endothermic shoulder temperature" in the DSC-60 system. Similarly, a glass transition temperature of the sample in the second temperature rising is determined by analyzing the DSC curve obtained in the second temperature rising using the analysis program "Endothermic shoulder temperature".

A melting point of the sample in the first temperature rising is determined by analyzing the DSC curve obtained in the first temperature rising using an analysis program "Peak temperature analysis program" in the DSC-60 system. Similarly, a melting point of the sample in the second temperature rising is determined by analyzing the DSC curve obtained in the second temperature rising using the analysis program "Peak temperature analysis program".

In the present disclosure, when the sample is a toner, the glass transition temperatures determined in the first temperature rising and the second temperature rising are denoted as Tg1st and Tg2nd, respectively.

In the present disclosure, the melting point and Tg determined in the second temperature rising are employed as the melting point and Tg of the sample.

Measurement Method of Particle Size Distribution

The volume average particle diameter (D4), number average particle diameter (Dn), and ratio (D4/Dn) therebetween of the toner can be measured using a particle size analyzer such as COULTER COUNTER TA-II and COULTER MULTISIZER II (both manufactured by Beckman Coulter, Inc.). In the present disclosure, a COULTER MULTISIZER II is used. The measurement method is as follows.

First, 0.1 to 5 mL of a surfactant (preferably a polyoxyethylene alkyl ether (i.e., a nonionic surfactant)), as a dispersant, is added to 100 to 150 mL of an electrolyte solution. Here, the electrolyte solution is an about 1% by mass NaCl aqueous solution prepared with the first grade sodium chloride, such as ISOTON-II (manufactured by Beckman Coulter, Inc.). A sample in an amount of from 2 to 20 mg is then added thereto. The electrolyte solution, in which the sample is suspended, is subjected to a dispersion treatment with an ultrasonic disperser for about 1 to 3 minutes. The electrolyte solution is thereafter subjected to a measurement of the volume and number of toner particles using the above measuring instrument equipped with a 100-μm aperture, to calculate volume and number distributions. The volume average particle diameter (D4) and number average particle diameter (Dn) are calculated from the volume and number distributions, respectively, measured above.

Thirteen channels with the following ranges are used for the measurement: not less than 2.00 μm and less than 2.52 μm; not less than 2.52 μm and less than 3.17 μm; not less than 3.17 μm and less than 4.00 μm; not less than 4.00 μm and less than 5.04 μm; not less than 5.04 μm and less than 6.35 μm; not less than 6.35 μm and less than 8.00 μm; not less than 8.00 μm and less than 10.08 μm; not less than 10.08 μm and less than 12.70 μm; not less than 12.70 μm and less than 16.00 μm; not less than 16.00 μm and less than 20.20 μm; not less than 20.20 μm and less than 25.40 μm; not less than 25.40 μm and less than 32.00 μm; and not less than 32.00 μm and less than 40.30 μm. Namely, particles having a particle diameter not less than 2.00 μm and less than 40.30 μm are to be measured.

External Additive

The toner according to an embodiment of the present invention includes toner base particles and an external additive containing silica particles.

A liberation ratio Xs of the silica particles liberated from the toner is from 40% to 75% when measured by an ultrasonic vibration method. A proportion R70 of the silica particles having a volume-based particle diameter of 70 nm or more in the silica particles liberated from the toner is from 70% to 90% by number. The silica particles contained in the external additive comprise at least two types of silica particles having different volume average particle diameters. The at least two types of silica particles comprise silica particles A having a volume average primary particle diameter of from 70 to 220 nm and silica particles B having a volume average primary particle diameter of from 15 to 50 nm, and an amount (Ma) of the silica particles A and an amount (Mb) of the silica particles B are from 1 to 4 parts by mass and from 0.5 to 3 parts by mass, respectively, based on 100 parts by mass of the toner base particles.

The BET specific surface area of the silica particle is preferably from 20 to 500 $m^2/g$.

The external additive may further contain, in combination with the silica particles, hydrophobic silica, metal salts of fatty acids (e.g., zinc stearate, aluminum stearate), metal oxides (e.g., titania, alumina, tin oxide, antimony oxide), and fluoropolymers.

Specific preferred examples of silica particles as the external additive include, but are not limited to, R972, R974, RX200, RY200, R202, R805, and R812 (manufactured by Nippon Aerosil Co., Ltd.). Specific examples of titania particles include, but are not limited to, P-25 (manufactured by Nippon Aerosil Co., Ltd.); STT-30 and STT-65C-S (manufactured by Titan Kogyo, Ltd.); TAF-140 (manufactured by Fuji Titanium Industry Co., Ltd.); and MT-150W, MT-500B, MT-600B, and MT-150A (manufactured by TAYCA Corporation).

Specific examples of hydrophobized titanium oxide particles include, but are not limited to, T-805 (manufactured by Nippon Aerosil Co., Ltd.); STT-30A and STT-65S-S (manufactured by Titan Kogyo, Ltd.); TAF-500T and TAF-1500T (manufactured by Fuji Titanium Industry Co., Ltd.); MT-100S and MT-100T (manufactured by TAYCA Corporation); and IT-S (manufactured by Ishihara Sangyo Kaisha, Ltd.).

The hydrophobized oxide particles, hydrophobized silica particles, hydrophobized titania particles, and hydrophobized alumina particles can be obtained by treating hydrophilic particles thereof with a silane coupling agent such as methyltrimethoxysilane, methyltriethoxysilane, and octyltrimethoxysilane. In addition, silicone-oil-treated oxide particles and silicone-oil-treated inorganic particles, which are treated with a silicone oil optionally upon application of heat, are also preferred.

Specific examples of the silicone oil include, but are not limited to, dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl- or methacryl-modified silicone oil, and α-methylstyrene-modified silicone oil. Specific examples of inorganic particles which can be used as the external additive include, but are not limited to, barium titanate, magnesium titanate, calcium titanate, strontium titanate, iron oxide, copper oxide, zinc oxide, tin oxide, quartz sand, clay, mica, sand-lime, diatomaceous earth, chromium oxide, cerium oxide, red iron oxide, antimony trioxide, magnesium oxide, zirconium oxide, barium sulfate, barium carbonate, calcium carbonate, silicon carbide, and silicon nitride. The average particle diameter of primary particles of the inorganic particles is not particularly limited and can be suitably selected to suit to a particular application, but is preferably 200 nm or less, more preferably from 10 to 100 nm. Within this range, the inorganic particles are less likely to be embedded in the toner, and the surface of the photoconductor is prevented from being damaged.

The liberation ratio Xs of the silica particles liberated from the toner measured by the ultrasonic vibration method and the proportion R70 of the silica particles having a volume-based particle diameter of 70 nm or more in the silica particles liberated from the toner are measured as follows.

Measurement of Liberation Ratio Xs of Silica Particles Measured By Ultrasonic Vibration Method First, in a 500-ml beaker, 10 g of a polyoxyalkylene alkyl ether (NOIGEN ET-165 manufactured by DKS Co., Ltd.) and 300 ml of pure water are placed and dispersed by ultrasonic waves for 1 hour to obtain a dispersion liquid A. After that, the dispersion liquid A is transferred to a 2-L volumetric flask and made up to 2 L. The resulting mixture is dissolved by ultrasonic waves for 1 hour to obtain a 0.5% dispersion liquid B. Next, 50 ml of the 0.5% dispersion liquid B is poured into a 110-ml screw tube, and 3.75 g of a sample (toner) is further added thereto. Stirring is performed for 30 to 90 minutes until the screw tube becomes familiar with the dispersion liquid. At this time, the rotation is reduced as much as possible to prevent formation of bubbles. Thus, a liquid C in which the toner is sufficiently dispersed is obtained. The vibrating part of an ultrasonic homogenizer (VCX 750 manufactured by SONICS and Materials, Inc., 750 watts) is made to enter the liquid C by 2.5 cm and vibrated at an output energy of 40% for 1 minute to prepare a liquid D. The liquid D is placed in a 50-ml centrifuge tube and centrifuged at 2,000 rpm for 2 minutes to obtain a supernatant liquid E and a precipitate. The precipitate is poured into a Sepa-Rohto while being washed with 60 ml of pure water, and the washing water is removed by suction filtration. The sample after filtration is put in a mini cup again, then 60 ml of water measured with a measuring cylinder is poured into the mini cup and stirred with a spatula handle 5 times. At this time, the stirring is performed not violently. The washing water is removed by suction filtration again, then the toner remaining on the filter paper is collected and dried in a constant temperature bath at 40 degrees C. for 8 hours. After drying, 3 g of the toner is collected and molded into a pellet having a diameter of 3 mm and a thickness of 2 mm using an automatic pressure molding machine (T-BRB-3 2 manufactured by MAEKAWA TESTING MACHINE MFG. Co., Ltd.) with a load of 6.0 t and a pressure time of 60 seconds, thus preparing a post-treatment sample toner.

On the other hand, the untreated toner as an initial sample toner is molded into a pellet having a diameter of 3 mm and a thickness of 2 mm using the automatic pressure molding machine in the same manner as above, thus preparing a pre-treatment sample toner.

Next, each of the post-treatment sample toner and the pre-treatment sample toner is quantitatively analyzed using an X-ray fluorescence apparatus (ZSX-100e manufactured by Rigaku Corporation) to measure the number of parts (by mass) of metal in each toner. The number of parts of metal is calculated by referring the quantitative analysis results by the X-ray fluorescence apparatus to a calibration curve prepared with toner samples each containing predetermined amounts of metal (for example, 0.1 part by mass, 1 part by mass, and 1.8 part by mass).

The liberation ratio of silica particles is calculated from the following formula (1).

$$\text{Liberation ratio } Xs=[\{\text{Metal content (parts by mass) in pre-treatment sample toner}-\text{Metal content (parts by mass) in post-treatment sample toner}\}/\text{Metal content (parts by mass) in pre-treatment sample toner}]\times 100 \quad (1)$$

In the formula (1), the metal represents silicon atom.

Measurement of Proportion R70 of Silica Particles Having Volume-Based Particle Diameter of 70 nm or More in Silica Particles Liberated from Toner The supernatant liquid E is subjected to a measurement by an ultrafine particle size distribution measuring device UPA-EX150 (manufactured by Nikkiso Co., Ltd.). Before the measurement, a dispersion treatment is performed using an ultrasonic homogenizer at 30 W for 30 seconds. The measurement conditions are set as follows: the surrounding environment is 23 degrees C./RH50%, the solvent refractive index is 1.333, the particle refractive index is 1.45, the number of channels is 52, the measurement time is 60 seconds, the particle shape is non-spherical, and the loading index is 0.200 to 0.300. The cumulative total of the frequencies of 0.07 μm or more indicated on 32 channels is defined as the proportion R70 (% by number).

The volume average primary particle diameter of the silica particles is calculated by observing the silica particles with a transmission electron microscope and measuring particle diameters of 20 or more of the silica particles.

Method for Manufacturing Toner

A method for manufacturing the toner is not particularly limited and can be suitably selected to suit to a particular application. Preferably, the toner is manufactured by dispersing, in an aqueous medium, an oil phase containing at least the amorphous polyester resin, the crystalline polyester resin, the release agent, and the colorant.

As an example of such a method for manufacturing the toner, a dissolution suspension method is known.

Another example of the method for manufacturing the toner includes the process of forming toner base particles while forming a reaction product (hereinafter may be referred to as "adhesive base material") through an elongation reaction and/or a cross-linking reaction of the active-hydrogen-group-containing compound with the polymer having a site reactive with an active-hydrogen-group-containing compound. This method involves the processes of preparation of an aqueous medium, preparation of an oil phase containing toner materials, emulsification or dispersion of the toner materials, and removal of an organic solvent.

Preparation of Aqueous Phase

The aqueous phase may be prepared by dispersing resin particles in an aqueous medium. The proportion of the resin particles to the aqueous medium is not particularly limited and can be suitably selected to suit to a particular application, but is preferably from 0.5% to 10% by mass. The resin particles are not particularly limited and can be suitably selected to suit to a particular application. Examples thereof include, but are not limited to, surfactants, poorly-water-soluble inorganic compound dispersants, and polymeric protection colloids. Each of these may be used alone or in combination with others. Among these, surfactants are preferred.

The aqueous medium is not particularly limited and can be suitably selected to suit to a particular application.

Specific examples thereof include, but are not limited to, water, water-miscible solvents, and mixtures thereof. Each of these can be used alone or in combination with others.

Among these, water is preferred.

The water-miscible solvents are not particularly limited and can be suitably selected to suit to a particular application. Examples thereof include, but are not limited to, alcohols, dimethylformamide, tetrahydrofuran, cellosolves, and lower ketones. The alcohols are not particularly limited and can be suitably selected to suit to a particular application. Specific examples thereof include, but are not limited to, methanol, isopropanol, and ethylene glycol. The lower ketones are not particularly limited and can be suitably selected to suit to a particular application. Specific examples thereof include, but are not limited to, acetone and methyl ethyl ketone.

Preparation of Oil Phase

The oil phase containing toner materials can be prepared by dissolving or dispersing, in an organic solvent, toner materials including the active-hydrogen-group-containing compound, the polymer having a site reactive with an active-hydrogen-group-containing compound, the crystalline polyester resin, the amorphous polyester resin, the release agent, the hybrid resin, the colorant, and the like.

The organic solvent is not particularly limited and can be suitably selected to suit to a particular application, but an organic solvent having a boiling point less than 150 degrees C. is preferred for easy removal.

The organic solvent having a boiling point less than 150 degrees C. is not particularly limited and can be suitably selected to suit to a particular application. Specific examples thereof include, but are not limited to, toluene, xylene, benzene, carbon tetrachloride, methylene chloride, 1,2-di chloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Each of these can be used alone or in combination with others.

Among these solvents, ethyl acetate, toluene, xylene, benzene, methylene chloride, 1,2-dichloroethane, chloroform, and carbon tetrachloride are preferred, and ethyl acetate is more preferred.

Emulsification or Dispersion

Emulsification or dispersion of the toner materials is performed by dispersing the oil phase containing the toner materials in the aqueous medium. At the time when the toner materials are emulsified or dispersed, the active-hydrogen-group-containing compound and the polymer having a site reactive with an active-hydrogen-group-containing compound are subjected to an elongation reaction and/or a cross-linking reaction to form an adhesive base material.

The adhesive base material may be produced by, for example, emulsifying or dispersing an oil phase containing a polymer reactive with an active hydrogen group, such as a polyester prepolymer having an isocyanate group, along with a compound having an active hydrogen group, such as an amine, in the aqueous medium to allow them to elongate and/or cross-link with each other in the aqueous medium; emulsifying or dispersing an oil phase containing toner materials in an aqueous medium to which a compound having an active hydrogen group is added in advance; or emulsifying or dispersing an oil phase containing toner materials in an aqueous medium and then adding a compound having an active hydrogen group thereto to allow them to elongate and/or cross-link with each other at the interfaces between the produced particles and the aqueous medium. In a case in which an elongation reaction and/or a cross-linking reaction is caused from the interfaces of dispersed particles, an urea-modified polyester resin is preferentially formed at the surface of the resulting toner while forming a concentration gradient of the urea-modified polyester within the toner.

The reaction conditions (e.g., reaction time, reaction temperature) for forming the adhesive base material are not particularly limited and determined depending on the combination of the active-hydrogen-group-containing compound and the polymer having a site reactive with an active-hydrogen-group-containing compound.

The reaction time is not particularly limited and can be suitably selected to suit to a particular application, but is preferably from 10 minutes to 40 hours, more preferably from 2 to 24 hours.

The reaction temperature is not particularly limited and can be suitably selected to suit to a particular application, but is preferably from 0 to 150 degrees C., more preferably from 40 to 98 degrees C.

A method for reliably forming a dispersion liquid containing the polymer having a site reactive with an active-hydrogen-group-containing compound (e.g., polyester prepolymer having an isocyanate group) is not particularly limited and can be suitably selected to suit to a particular application. Examples thereof include a method of adding, in an aqueous medium, an oil phase prepared by dissolving or dispersing toner materials in a solvent, and dispersing the oil phase therein by application of a shearing force.

A disperser for dispersing the oil phase is not particularly limited and can be suitably selected to suit to a particular application. Examples thereof include, but are not limited to, low-speed shear-type dispersers, high-speed shear-type dispersers, friction-type dispersers, high-pressure jet dispersers, and ultrasonic dispersers.

Among these dispersers, high-speed shear-type dispersers are preferred because they can adjust the particle diameter of the dispersoids (oil droplets) to 2 to 20 μm.

When the high-speed shear-type disperser is used, dispersing conditions, such as the number of revolutions, dispersing time, and dispersing temperature, can be determined depending on the purpose.

The number of revolutions is not particularly limited and can be suitably selected to suit to a particular application, but is preferably from 1,000 to 30,000 rpm, more preferably from 5,000 rpm to 20,000 rpm.

The dispersing time is not particularly limited and can be suitably selected to suit to a particular application, but is preferably from 0.1 to 5 minutes in the case of batch-type disperser.

The dispersing temperature is not particularly limited and can be suitably selected to suit to a particular application, but is preferably from 0 to 150 degrees C., more preferably from 40 to 98 degrees C., under pressure. Generally, as the dispersing temperature becomes higher, the dispersing becomes easier.

The amount of the aqueous medium used to emulsify or disperse the toner materials is not particularly limited and can be suitably selected to suit to a particular application, but is preferably from 50 to 2,000 parts by mass, more preferably from 100 to 1,000 parts by mass, based on 100 parts by mass of the toner materials.

When the amount of the aqueous medium used is 50 parts by mass or more, the dispersion state of the toner materials is good, and toner base particles having a desired particle diameter can be obtained. When the amount is 2,000 parts by mass or less, production cost can be reduced.

Preferably, when the oil phase containing the toner materials is emulsified or dispersed in the aqueous medium, a dispersant is used to stabilize dispersoids (oil droplets) to obtain toner particles with a desired shape and a narrow particle size distribution.

The dispersant is not particularly limited and can be suitably selected to suit to a particular application. Examples thereof include, but are not limited to, surfactants, poorly-water-soluble inorganic compound dispersants, and polymeric protection colloids. Each of these can be used alone or in combination with others. Among these, surfactants are preferred.

The surfactants are not particularly limited and can be suitably selected to suit to a particular application. Examples thereof include, but are not limited to, anionic surfactants, cationic surfactants, nonionic surfactants, and ampholytic surfactants.

The anionic surfactants are not particularly limited and can be suitably selected to suit to a particular application. Specific examples thereof include, but are not limited to, alkylbenzene sulfonates, α-olefin sulfonates, and phosphates.

Among these surfactants, those having a fluoroalkyl group are preferred.

In the elongation reaction and/or cross-linking reaction for forming the adhesive base material, a catalyst may be used.

The catalyst is not particularly limited and can be suitably selected to suit to a particular application. Specific examples thereof include, but are not limited to, dibutyltin laurate and dioctyltin laurate.

Removal of Organic Solvent

A method for removing the organic solvent from the dispersion liquid (emulsion slurry) is not particularly limited and can be suitably selected to suit to a particular application. For example, the method may include the process of gradually raising the temperature of the reaction system to completely evaporate the organic solvent from oil droplets, or spraying the dispersion liquid into dry atmosphere to completely evaporate the organic solvent from oil droplets.

As the organic solvent has been removed, toner base particles are formed. The toner base particles may be washed and dried, and optionally classified by size. The classification may be performed in a liquid by removing ultrafine particles by cyclone separation, decantation, or centrifugal separation. Alternatively, the classification may be performed after the drying.

The toner base particles may be further mixed with particles of the external additive, the charge controlling agent, or the like. By applying a mechanical impact in the mixing, the particles of the external additive, etc., are suppressed from releasing from the surface of the toner base particles.

A method for applying a mechanical impulsive force is not particularly limited and can be suitably selected to suit to a particular application. For example, the method may be performed by using blades rotating at a high speed, or by accelerating the particles in a high-speed airflow to allow the particles collide with each other or with a collision plate.

An apparatus used to perform the method is not particularly limited and can be suitably selected to suit to a particular application. Specific examples of such an apparatus include, but are not limited to, ONG MILL (manufactured by Hosokawa Micron Corporation), a modified I-TYPE MILL (manufactured by Nippon Pneumatic Mfg. Co., Ltd.) in which the pulverizing air pressure is reduced, HYBRIDIZATION SYSTEM (manufactured by Nara Machinery Co., Ltd.), KRYPTON SYSTEM (manufactured by Kawasaki Heavy Industries, Ltd.), and an automatic mortar.

Developer

A developer according to an embodiment of the present invention comprises at least the above-described toner and optionally other components such as a carrier.

The developer has excellent transferability and chargeability and is capable of reliably forming high-quality image. The developer may be either one-component developer or two-component developer. To be used for high-speed printers corresponding to recent improvement in information processing speed, two-component developer is preferred, because the lifespan of the printer can be extended.

In the case of one-component developer, even when toner supply and toner consumption are repeatedly performed, the particle diameter of the toner fluctuates very little. In addition, neither toner filming on a developing roller nor toner fusing to a layer thickness regulating member (e.g., a blade for forming a thin layer of toner) occurs. Thus, even when the developer is used (stirred) in a developing device for a long period of time, developability and image quality remain good and stable.

In the case of two-component developer, even when toner supply and toner consumption are repeatedly performed for a long period of time, the particle diameter of the toner fluctuates very little. Thus, even when the developer is stirred in a developing device for a long period of time, developability and image quality remain good and stable.

The two-component developer may be prepared by mixing the above toner with a carrier. The proportion of the carrier in the two-component developer is not particularly limited and can be suitably selected to suit to a particular application, but is preferably from 90% to 98% by mass, more preferably from 93% to 97% by mass.

Carrier

The carrier is not particularly limited and can be suitably selected to suit to a particular application, but the carrier preferably comprises a core material and a resin layer that covers the core material.

Core Material

The core material is not particularly limited and can be suitably selected to suit to a particular application. Specific examples thereof include, but are not limited to, manganese-strontium or manganese-magnesium materials having a magnetization of from 50 to 90 emu/g. For securing image density, high magnetization materials, such as iron powders having a magnetization of 100 emu/g or more and magnetites having a magnetization of from 75 to 120 emu/g, are preferred. Additionally, low magnetization materials, such as copper-zinc materials having a magnetization of from 30 to 80 emu/g, are preferred for improving image quality, because such materials are capable of reducing the impact of the magnetic brush to a photoconductor.

Each of these can be used alone or in combination with others.

The volume average particle diameter of the core material is not particularly limited and can be suitably selected to suit to a particular application, but is preferably from 10 to 150 μm, more preferably from 40 to 100 μm. When the volume average particle diameter is 10 μm or more, the amount of fine powder in the resulting carrier is not so large, and carrier scattering due to a decrease of the magnetization per carrier particle can be prevented. When the volume average particle diameter is 150 μm or less, a decrease of the specific surface area is suppressed, and toner scattering is prevented. Therefore, in full-color images having a lot of solid portions, the solid portions can be reliably reproduced.

Resin Layer

The material of the resin layer is not particularly limited and can be suitably selected to suit to a particular application. Specific examples thereof include, but are not limited to, amino resin, polyvinyl resin, polystyrene resin, polyhalogenated olefin, polyester resin, polycarbonate resin, polyethylene, polyvinyl fluoride, polyvinylidene fluoride, polytrifluoroethylene, polyhexafluoropropylene, copolymer of vinylidene fluoride with an acrylic monomer, copolymer of vinylidene fluoride with vinyl fluoride, fluoroterpolymer (e.g., terpolymer of tetrafluoroethylene, vinylidene fluoride, and a monomer free of fluoro group), and silicone resin.

Each of these can be used alone or in combination with others.

The amino resin is not particularly limited and can be suitably selected to suit to a particular application. Examples thereof include, but are not limited to, urea-formaldehyde resin, melamine resin, benzoguanamine resin, urea resin, polyamide resin, and epoxy resin.

The polyvinyl resin is not particularly limited and can be suitably selected to suit to a particular application. Examples thereof include, but are not limited to, acrylic resin, polymethyl methacrylate, polyacrylonitrile, polyvinyl acetate, polyvinyl alcohol, and polyvinyl butyral.

The polystyrene resin is not particularly limited and can be suitably selected to suit to a particular application. Examples thereof include, but are not limited to, polystyrene and styrene-acryl copolymer.

The polyhalogenated olefin is not particularly limited and can be suitably selected to suit to a particular application. Examples thereof include, but are not limited to, polyvinyl chloride.

The polyester resin is not particularly limited and can be suitably selected to suit to a particular application. Examples thereof include, but are not limited to, polyethylene terephthalate and polybutylene terephthalate.

The resin layer may contain a conductive powder, as necessary. The conductive powder is not particularly limited and can be suitably selected to suit to a particular application. Examples thereof include, but are not limited to, metal powder, carbon black, titanium oxide, tin oxide, and zinc oxide. Preferably, the conductive powder has an average particle diameter of 1 μm or less. When the average particle diameter is 1 μm or less, it is easy to control electrical resistance.

The resin layer can be formed by, for example, dissolving a silicone resin, etc., in a solvent to prepare a coating liquid and uniformly coating the surface of the core material with the coating liquid by a known coating method, followed by drying and baking.

The coating method is not particularly limited and can be suitably selected to suit to a particular application. Specific examples thereof include, but are not limited to, dipping, spraying, and brush coating.

The solvent is not particularly limited and can be suitably selected to suit to a particular application. Specific examples thereof include, but are not limited to, toluene, xylene, methyl ethyl ketone, methyl isobutyl ketone, and butyl acetate cellosolve.

The baking method may be either an external heating method or an internal heating method, such as a method using a stationary electric furnace, fluid electric furnace, rotary electric furnace, or burner furnace, and a method using microwave.

The proportion of the resin layer in the carrier is not particularly limited and can be suitably selected to suit to a particular application, but is preferably from 0.01% to 5.0% by mass. When the proportion is 0.01% by mass or more, the resin layer is uniformly formed on the surface of the core material. When the proportion is 5.0% by mass or less, carrier particles are prevented from fusing with each other and become more uniform.

Image Bearer

The material, shape, structure, size, and the like of the image bearer are not particularly limited and can be suitably selected to suit to a particular application.

The shape of the image bearer may be, for example, a drum shape, a belt shape, a flat plate shape, or a sheet shape. The size of the image bearer is not particularly limited and can be suitably selected to suit to a particular application. Preferably, the image bearer is in a size that is generally used.

The material of the image bearer is not particularly limited and can be suitably selected to suit to a particular application. Examples thereof include, but are not limited to, metals, plastics, and ceramics.

Image Forming Apparatus

An image forming apparatus according to an embodiment of the present invention includes an image bearer and a cleaning blade configured to remove toner particles remaining on the image bearer. Specifically, the image forming apparatus preferably includes: an image bearer; a charger configured to charge a surface of the image bearer by contact with the image bearer to apply an alternating current voltage thereto; an irradiator configured to irradiate the charged surface of the image bearer to form an electrostatic latent image; a developing device configured to develop the electrostatic latent image with a toner to form a visible image; a transfer device configured to transfer the visible image onto a recording medium; a fixing device configured to fix the transferred visible image on the recording medium; and a cleaner configured to remove toner particles remaining on the image bearer. Here, the cleaner is the cleaning blade according to an embodiment of the present invention. The image bearer may be provided with a mechanism for applying a lubricant as a cleaning assisting device.

Image Forming Method

An image forming method according to an embodiment of the present invention includes the step of removing toner particles remaining on an image bearer with a cleaning blade. Specifically, the image forming method includes the processes of: forming an electrostatic latent image on an image bearer; developing the electrostatic latent image with a toner to form a visible image; and removing toner particles remaining on the image bearer with a cleaning blade. According to a preferred embodiment, the image forming method includes: a charging process for charging a surface of an image bearer; an irradiating process for irradiating the charged surface of the image bearer to form an electrostatic latent image; a developing process for developing the electrostatic latent image with a toner to form a visible image; a transfer process for transferring the visible image onto a recording medium; a fixing process for fixing the transferred visible image on the recording medium; and a cleaning process for removing toner particles remaining on the image bearer. Here, the cleaning blade according to an embodiment of the present invention is used in the cleaning process.

As an example of the image forming apparatus according to an embodiment of the present invention, an electrophotographic printer 500 (hereinafter simply "printer 500") is described in detail below. First, the basic configuration of the printer 500 is described.

Figure 5:
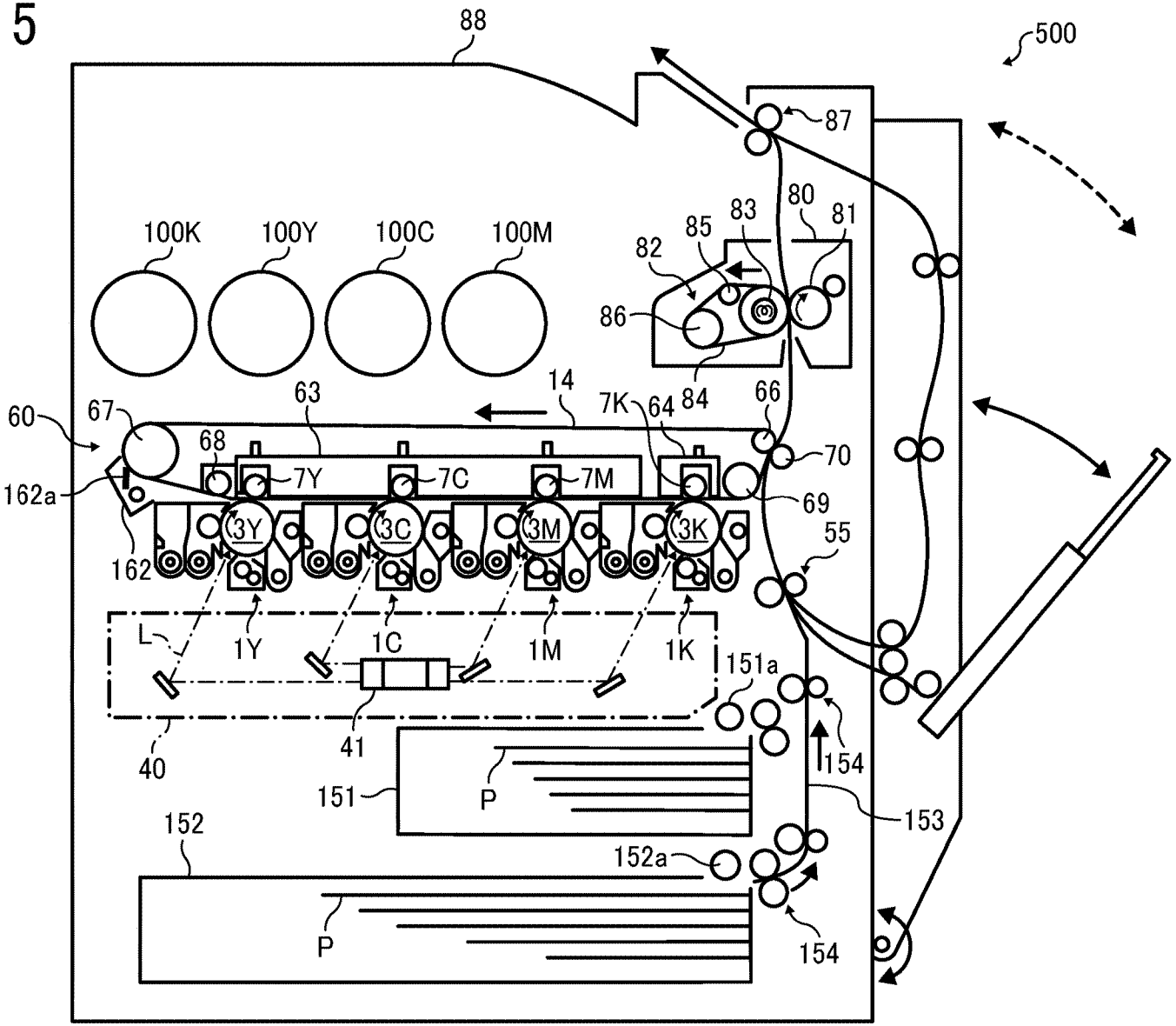
FIG. 5 is a schematic diagram illustrating an image forming apparatus according to an embodiment of the present invention.

FIG. 5 is a schematic diagram illustrating the printer 500. The printer 500 includes four image forming units 1Y, 1C, 1M, and 1K for forming yellow, cyan, magenta, and black (hereinafter simply "Y, C, M, and K") images, respectively. The image forming units 1Y, 1C, 1M, and 1K have the same configuration except for storing different color toners, i.e., yellow, cyan, magenta, and black toners, respectively, as image forming materials.

Above the four image forming units 1Y, 1C, 1M, and 1K (hereinafter collectively "image forming units 1"), a transfer unit 60 is disposed. The transfer unit 60 includes an intermediate transfer belt 14 as an intermediate transferor. The image forming units 1Y, 1C, 1M, and 1K include respective photoconductors 3Y, 3C, 3M, and 3K on which toner images with respective colors are to be formed. The toner images are superimposed on one another on a surface of the intermediate transfer belt 14.

Below the four image forming units 1, an optical writing unit 40 is disposed. The optical writing unit 40, serving as a latent image forming device, emits laser light L based on image information to the photoconductors 3Y, 3C, 3M, and 3K in the respective image forming units 1Y, 1C, 1M, and 1K. Thus, electrostatic latent images for yellow, cyan, magenta, and black images are formed on the respective photoconductors 3Y, 3C, 3M, and 3K. In the optical writing unit 40, the laser light L is emitted from a light source, deflected by a polygon mirror 41 that is rotary-driven by a motor, and directed to the photoconductors 3Y, 3C, 3M, and 3K through multiple optical lenses and mirrors. Alternatively, the optical writing unit 40 can be replaced with another unit in which an LED (light emitting diode) array performs optical scanning.

Below the optical writing unit 40, a first sheet feeding cassette 151 and a second sheet feeding cassette 152 are disposed so as to overlap in the vertical direction. In each sheet feeding cassette, multiple transfer sheets P, serving as recording media, are stacked on top of another. The top transfer sheet P in each sheet feeding cassette is in contact with a first sheet feeding roller 151*a* or a second sheet feeding roller 152*a*. As the first sheet feeding roller 151*a* is rotary-driven counterclockwise in FIG. 5 by a driver, the top transfer sheet Pin the first sheet feeding cassette 151 is fed to a sheet feeding path 153 that is vertically extended on a right side of the sheet feeding cassettes in FIG. 5. As the second sheet feeding roller 152*a* is rotary-driven counterclockwise in FIG. 5 by a driver, the top transfer sheet P in the second sheet feeding cassette 152 is fed to the sheet feeding path 153.

On the sheet feeding path 153, multiple conveyance roller pairs 154 are disposed. The transfer sheet P fed to the sheet feeding path 153 is conveyed upward in FIG. 5 inside the sheet feeding path 153 while being nipped by the rollers of the conveyance roller pairs 154.

On a downstream end of the sheet feeding path 153 relative to the direction of conveyance of the transfer sheet P, a registration roller pair 55 is disposed. The rollers of the registration roller pair 55 nip the transfer sheet P fed by the conveyance roller pairs 154 and stop rotating immediately thereafter. The registration roller pair 55 then timely feeds the transfer sheet P to a secondary transfer nip (to be described later).

Figure 6:
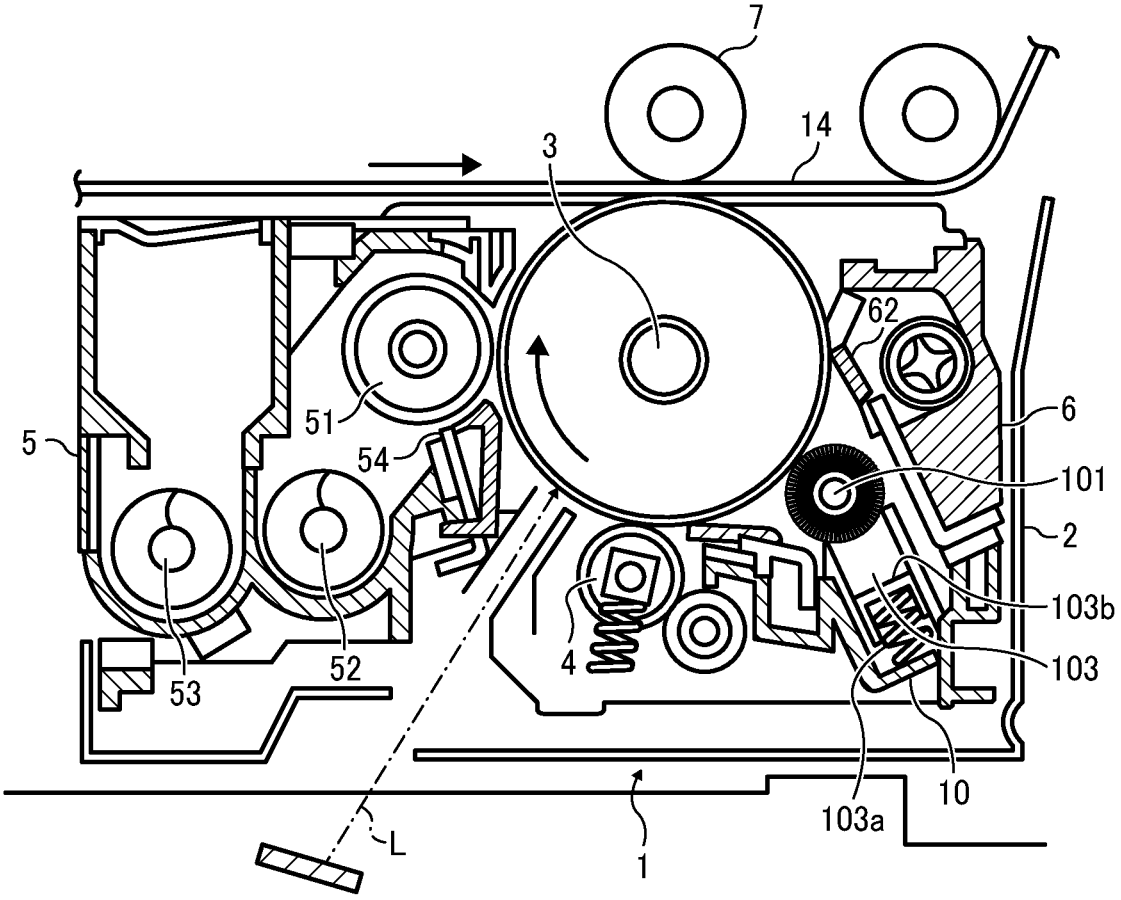
FIG. 6 is a schematic diagram illustrating an image forming unit in the image forming apparatus according to an embodiment of the present invention.

FIG. 6 is a schematic diagram illustrating one of the four image forming units 1. As illustrated in FIG. 6, the image forming unit 1 includes a drum-like photoconductor 3 serving as an image bearer. The photoconductor 3 is in a drum-like shape but may also be in a sheet-like shape or an endless-belt-like shape. Around the photoconductor 3, a charging roller 4, a developing device 5, a primary transfer roller 7, a cleaner 6, a lubricant applicator 10, and a neutralization lamp are disposed. The charging roller 4 is a charging member of a charger. The developing device 5 is configured to develop a latent image formed on a surface of the photoconductor 3 into a toner image. The primary transfer roller 7 is a primary transfer member of a primary transfer device, and is configured to transfer the toner image on the surface of the photoconductor 3 onto the intermediate transfer belt 14. The cleaner 6 is configured to remove residual toner particles remaining on the photoconductor 3 after the toner image has been transferred therefrom onto the intermediate transfer belt 14. The lubricant applicator 10 is configured to apply a lubricant to the surface of the photoconductor 3 having been cleaned by the cleaner 6. The neutralization lamp is a neutralizer configured to neutralize the surface potential of the photoconductor 3 having been cleaned.

The charging roller 4 is disposed at a predetermined distance from the photoconductor 3 without contacting the photoconductor 3. The charging roller 4 is configured to charge the photoconductor 3 to a predetermined potential with a predetermined polarity. After the charging roller 4 has uniformly charged the surface of the photoconductor 3, the optical writing unit 40 emits the laser light L to the charged surface of the photoconductor 3 based on image information to form an electrostatic latent image.

The developing device 5 includes a developing roller 51 serving as a developer bearer. The developing roller 51 is configured to be applied with a developing bias from a power source. In the casing of the developing device 5, a supply screw 52 and a stirring screw 53 are provided for stirring the developer contained in the casing while conveying the developer in opposite directions. Also, a doctor 54 for regulating the developer carried on the developing roller 51 is disposed within the casing. As the developer is stirred and conveyed by the supply screw 52 and the stirring screw 53, toner particles in the developer are charged to have a predetermined polarity. The developer is then carried on the surface of the developing roller 51 and regulated by the doctor 54. Toner particles in the developer adhere to a latent image formed on the photoconductor 3 at a developing region where the developing roller 51 faces the photoconductor 3.

The cleaner 6 includes a fur brush 101 and the cleaning blade 62. The cleaning blade 62 is in contact with the photoconductor 3 so as to face in the direction of movement of the surface of the photoconductor 3. The cleaning blade 62 is the cleaning blade according to an embodiment of the present invention. The lubricant applicator 10 includes a solid lubricant 103 and a lubricant pressing spring 103*a*. The fur brush 101 serves as an application brush that applies the solid lubricant 103 to the photoconductor 3. The solid lubricant 103 is held by a bracket 103*b* and pressed toward the fur brush 101 by the lubricant pressing spring 103*a*. As the fur brush 101 rotates so as to trail the rotation of the photoconductor 3, the solid lubricant 103 is scraped by the fur brush 101 and the scraped-off lubricant is applied to the photoconductor 3. By application of the lubricant to the photoconductor 3, it is preferable that the coefficient of friction of the surface of the photoconductor 3 be maintained at 0.2 or less during non-image forming periods.

The charger of the present embodiment employs a non-contact proximity arrangement system in which the charging roller 4 is disposed in proximity to the photoconductor 3 without contacting the photoconductor 3. Alternatively, any known charger such as a corotron, a scorotron, and a solid state charger can also be used as the charger. Among these charging systems, contact charging systems and non-contact proximity arrangement systems are preferred, since they have advantages of high charging efficiency, less generation of ozone, and compact size.

Examples of the light source of the optical writing unit 40 that emits the laser light L and the light source of the neutralization lamp include all luminous matters such as fluorescent lamp, tungsten lamp, halogen lamp, mercury lamp, sodium-vapor lamp, light-emitting diode (LED), laser diode (LD), and electroluminescence (EL). For the purpose of emitting only light having a desired wavelength, any type of filter can be used, such as sharp cut filter, band pass filter, near infrared cut filter, dichroic filter, interference filter, and color-temperature conversion filter. Among these light sources, light-emitting diode and semiconductor laser are preferred since they can emit long-wavelength light (600-800 nm) with high energy.

The transfer unit 60 serving as a transfer device further includes, in addition to the intermediate transfer belt 14, a belt cleaning unit 162, a first bracket 63, and a second bracket 64. The transfer unit 60 further includes four primary transfer rollers 7Y, 7C, 7M, and 7K, a secondary transfer backup roller 66, a driving roller 67, an auxiliary roller 68, and a tension roller 69. The intermediate transfer belt 14 is stretched taut with these eight rollers and is rotary-driven by the driving roller 67 to endlessly move counterclockwise in FIG. 5. The four primary transfer rollers 7Y, 7C, 7M, and 7K and the respective photoconductors 3Y, 3C, 3M, and 3K are sandwiching the intermediate transfer belt 14 that is endlessly moved, forming respective primary transfer nips therebetween. The back surface (i.e., inner circumferential surface of the loop) of the intermediate transfer belt 14 is then applied with a transfer bias having the opposite polarity to the toner (e.g., positive polarity). As the intermediate transfer belt 14 endlessly moves while sequentially passing the primary transfer nips of yellow, cyan, magenta, and black, the toner images of yellow, cyan, magenta, and black formed on the respective photoconductors 3Y, 3C, 3M, and 3K are superimposed on one another on the outer circumferential surface of the intermediate transfer belt 14. Thus, a composite toner image in which four color toner images are superimposed on one another is formed on the intermediate transfer belt 14.

The secondary transfer backup roller 66 and a secondary transfer roller 70, disposed outside the loop of the intermediate transfer belt 14, are sandwiching the intermediate transfer belt 14 to form a secondary transfer nip therebetween. The registration roller pair 55 feeds the transfer sheet P to the secondary transfer nip in synchronization with an entry of the composite toner image on the intermediate transfer belt 14 into the secondary transfer nip. The composite toner image on the intermediate transfer belt 14 is secondarily transferred onto the transfer sheet P in the secondary transfer nip by the actions of a secondary transfer electric field and the nip pressure. The secondary transfer electric field is formed between the secondary transfer roller 70 to which a secondary transfer bias is applied and the secondary transfer backup roller 66. The composite toner image is combined with the white color of the transfer sheet P to become a full-color toner image.

On the intermediate transfer belt 14 having passed through the secondary transfer nip, residual toner particles which have not been transferred onto the transfer sheet P are remaining. These residual toner particles are removed by the belt cleaning unit 162. The belt cleaning unit 162 includes a belt cleaning blade 162*a* in contact with the outer circumferential surface of the intermediate transfer belt 14. The belt cleaning blade 162*a* scrapes off the residual toner particles from the intermediate transfer belt 14.

The first bracket 63 of the transfer unit 60 is swingable about the rotation axis of the auxiliary roller 68 at a predetermined angle in accordance with on/off driving operation of a solenoid. When the printer 500 is to form a black-and-white image, the first bracket 63 is slightly rotated counterclockwise in FIG. 5 by driving the solenoid. This rotation of the first bracket 63 makes the primary transfer rollers 7Y, 7C, and 7M revolve counterclockwise in FIG. 5 about the rotation axis of the auxiliary roller 68 to bring the intermediate transfer belt 14 away from the photoconductors 3Y, 3C, and 3M. Thus, among the four image forming units 1Y, 1C, 1M, and 1K, only the image forming unit 1K for black image is brought into operation to form a black-and-white image. Since unnecessary driving of the image forming units 1Y, 1C, and 1M is avoid during formation of the black-and-white image, undesired deterioration of compositional members of the image forming units 1Y, 1C, and 1M can be prevented.

Above the secondary transfer nip, a fixing unit 80 is disposed. The fixing unit 80 includes a pressure heating roller 81 and a fixing belt unit 82. The pressure heating roller 81 contains a heat source, such as a halogen lamp, inside. The fixing belt unit 82 includes a fixing belt 84, serving as a fixing member, a heating roller 83, a tension roller 85, a driving roller 86, and a temperature sensor. The heating roller 83 contains a heat source, such as a halogen lamp, inside. The fixing belt 84 in an endless-belt-like form is stretched taut with the heating roller 83, the tension roller 85, and the driving roller 86, and is endlessly moved counterclockwise in FIG. 5. The fixing belt 84 is heated from its back surface side by the heating roller 83 while endlessly moving. At a position where the fixing belt 84 is wound around the heating roller 83, the pressure heating roller 81 is contacting the outer circumferential surface of the fixing belt 84. The pressure heating roller 81 is driven to rotate clockwise in FIG. 5. Thus, the pressure heating roller 81 and the fixing belt 84 form a fixing nip therebetween.

The temperature sensor is disposed outside the loop of the fixing belt 84 facing the outer circumferential surface of the fixing belt 84 forming a predetermined gap therebetween. The temperature sensor detects the surface temperature of the fixing belt 84 immediately before entering into the fixing nip. The detection result is transmitted to a fixing power supply circuit. The fixing power supply circuit on/off controls power supply to the heat sources contained in the heating roller 83 and the pressure heating roller 81 based on the detection result.

The transfer sheet P having passed though the secondary transfer nip is then separated from the intermediate transfer belt 14 and fed to the fixing unit 80. The transfer sheet P is fed upward in FIG. 5 while being sandwiched by the fixing nip in the fixing unit 80. During this process, the transfer sheet P is heated and pressurized by the fixing belt 84, and the full-color toner image is fixed on the transfer sheet P.

The transfer sheet P having the fixed image thereon is passed through an ejection roller pair 87 and ejected outside the printer 500. On the top surface of the housing of the printer 500, a stack part 88 is formed. The transfer sheets P ejected by the ejection roller pair 87 are successively stacked on the stack part 88.

Above the transfer unit 60, four toner cartridges 100Y, 100C, 100M, and 100K storing yellow toner, cyan toner, magenta toner, and black toner, respectively, are disposed. The yellow, cyan, magenta, and black toners stored in the respective toner cartridges 100Y, 100C, 100M, and 100K are supplied to the respective developing devices 5Y, 5C, 5M, and 5K in the respective image forming units 1Y, 1C, 1M, and 1K. The toner cartridges 100Y, 100C, 100M, and 100K are detachably mountable on the printer main body independent from the image forming units 1Y, 1C, 1M, and 1K.

Next, an image forming operation of the printer 500 is described below. In response to receipt of a print execution signal from an operation panel, the charging roller 4 and the developing roller 51 are each applied with a predetermined voltage or current at a predetermined timing. Similarly, the light sources in the optical writing unit 40 and the neutralization lamp are each applied with a predetermined voltage or current at a predetermined timing. In synchronization of the application of voltage or current, the photoconductor 3 is driven to rotate in a direction indicated by arrow in FIG. 6 by a photoconductor driving motor.

As the photoconductor 3 rotates clockwise in FIG. 6, the surface of the photoconductor 3 is uniformly charged to a predetermined potential by the charging roller 4. The optical writing unit 40 emits the laser light L to the charged surface of the photoconductor 3 based on image information. A part of the surface of the photoconductor 3 irradiated with the laser light L is neutralized, thereby forming an electrostatic latent image.

The surface of the photoconductor 3 having the electrostatic latent image thereon is rubbed by a magnetic brush formed of the developer on the developing roller 51 at a position where the photoconductor 3 is facing the developing device 5. As a developing bias is applied to the developing roller 51, negatively-charged toner particles on the developing roller 51 are transferred onto the electrostatic latent image, thus forming a toner image. This image forming process is performed in each of the image forming units 1Y, 1C, 1M, and 1K to form yellow, cyan, magenta, and black toner images on the photoconductors 3Y, 3C, 3M, and 3K, respectively.

Thus, in the printer 500, the developing device 5 develops the electrostatic latent image formed on the photoconductor 3 with negatively-charged toner particles based on reversal development. In the present embodiment, an N/P (negative/positive) development system (in which toner particles are adhered to low-potential regions) and a non-contact charging roller are employed, but the development and charging systems are not limited thereto.

The toner images of yellow, cyan, magenta, and black formed on the respective photoconductors 3Y, 3C, 3M, and 3K are primarily transferred onto the surface of the intermediate transfer belt 14 in such a manner that they are superimposed on one another. Thus, a composite toner image is formed on the intermediate transfer belt 14.

The composite toner image (hereinafter "toner image" for simplicity) formed on the intermediate transfer belt 14 is transferred onto the transfer sheet P which has been fed from the first sheet feeding cassette 151 or second sheet feeding cassette 152, passed through the registration roller pair 55, and fed to the secondary transfer nip. The transfer sheet P is once stopped by being sandwiched by the registration roller pair 55, and then fed to the secondary transfer nip in synchronization with an entry of the leading edge of the toner image on the intermediate transfer belt 14 into the secondary transfer nip. The transfer sheet P having the transferred toner image thereon is then separated from the intermediate transfer belt 14 and fed to the fixing unit 80. As the transfer sheet P having the transferred toner image thereon is passed through the fixing unit 80, the toner image is fixed on the transfer sheet P by heat and pressure. The transfer sheet P having the fixed toner image thereon is ejected outside the printer 500 and stacked at the stack part 88.

On the other hand, after the toner image has been transferred from the surface of the intermediate transfer belt 14 onto the transfer sheet P in the secondary transfer nip, the belt cleaning unit 162 removes residual toner particles remaining on the surface of the intermediate transfer belt 14. Similarly, after the toner image has been transferred from the surface of the photoconductor 3 onto the intermediate transfer belt 14 in the primary transfer nip, the cleaner 6 removes residual toner particles remaining on the surface of the photoconductor 3. The lubricant applicator 10 then applies a lubricant to the cleaned surface and the neutralization lamp further neutralizes the surface.

As illustrated in FIG. 6, the image forming unit 1 of the printer 500 has a frame body 2 accommodating the photoconductor 3 and processing devices including the charging roller 4, the developing device 5, the cleaner 6, and the lubricant applicator 10. The image forming unit 1 is temporarily detachable from the main body of the printer 500 as a process cartridge. Thus, in the printer 500, the photoconductor 3 and the processing devices are replaceable at the same time by replacing the image forming unit 1 as the process cartridge. Alternatively, each of the photoconductor 3, the charging roller 4, the developing device 5, the cleaner 6, and the lubricant applicator 10 may be independently replaceable.

EXAMPLES

The embodiments of the present invention are further described in detail with reference to the following Examples but are not limited to these Examples. In the following descriptions, "parts" and "%" represent "parts by mass" and "% by mass", respectively.

Production of Toners

Production Example 1-1

Synthesis of Crystalline Polyester Resin 1

A reaction vessel equipped with a nitrogen introducing tube, a dewatering tube, a stirrer, and a thermocouple was charged with sebacic acid and 1,10-decanediol. The molar ratio of hydroxyl groups to carboxyl groups was 0.9. Furthermore, 500 ppm (based on all the monomers) of titanium tetraisopropoxide was added to the vessel. Next, a reaction was performed at 180 degrees C. for 10 hours and subsequently at 200 degrees C. for 3 hours. Further, a reaction was performed under a reduced pressure of 8.3 kPa for 2 hours. Thus, a crystalline polyester resin 1 was prepared. The crystalline polyester resin 1 was found to have a melting point of 62 degrees C. and a weight average molecular weight of 28,000.

Production Example 1-2

Synthesis of Crystalline Polyester Resin 2

A crystalline polyester resin 2 was obtained in the same manner as in Synthesis of Crystalline Polyester Resin 1 except that the 1,10-decanediol was replaced with 1,2-ethylene glycol. The crystalline polyester resin 2 was found to have a melting point of 73 degrees C. and a weight average molecular weight of 20,000.

Production Example 2-1

Synthesis of Amorphous Polyester Resin 1

In a 5-liter four-necked flask equipped with a nitrogen introducing tube, a dewatering tube, a stirrer, and a thermocouple, 1427.5 g of propylene oxide 2-mol adduct of bisphenol A, 20.2 g of trimethylolpropane, 512.7 g of terephthalic acid, and 119.9 g of adipic acid were put, and allowed to react at 230 degrees C. under normal pressure for 10 hours and subsequently under reduced pressures of from 10 to 15 mmHg for 5 hours. Further, 41.0 g of trimellitic anhydride were further put in the flask and allowed to react at 180 degrees C. under normal pressure for 3 hours. Thus, an amorphous polyester resin 1 was prepared.

The amorphous polyester resin 1 was found to have a weight average molecular weight of 10,000, a number average molecular weight of 2,900, a Tg of 57.5 degrees C., and an acid value of 20 mgKOH/g.

Production Example 3-1

Preparation of Crystalline Polyester Resin Dispersion Liquid 1

In a 2-liter metallic vessel, 100 g of the crystalline polyester resin 1 and 200 g of ethyl acetate were put, then heat-melted at 75 degrees C., and rapidly cooled at a rate of 27 degrees C./min in an ice water bath. After adding 500 mL of glass beads (having a diameter of 3 mm) to the vessel, the vessel contents were subjected to a pulverization treatment by a batch-type sand mill (manufactured by Kanpe Hapio Co., Ltd.) for 10 hours. Thus, a crystalline polyester dispersion liquid 1 was prepared.

Production Example 3-2

Preparation of Crystalline Polyester Resin Dispersion Liquid 2

A crystalline polyester resin dispersion liquid 2 was obtained in the same manner as in Production Example 3-1 except that the crystalline polyester resin 1 was replaced with the crystalline polyester resin 2.

Example 1

Cleaning Blade

A blade (a) having a Martens hardness of 5 N/mm$^2$ under a load of 1 μN, a Tan δ peak temperature of 4 degrees C., and an elastic power of 90% was used.

Preparation of Toner

Preparation of Oil Phase

Synthesis of Prepolymer

In a reaction vessel equipped with a condenser tube, a stirrer, and a nitrogen introducing tube, 682 parts of ethylene oxide 2-mol adduct of bisphenol A, 81 parts of propylene oxide 2-mol adduct of bisphenol A, 283 parts of terephthalic acid, 22 parts of trimellitic anhydride, and 2 parts of dibutyltin oxide were put, and allowed to react at 230 degrees C. under normal pressure for 8 hours and subsequently under reduced pressures of from 10 to 15 mmHg for 5 hours. Thus, an intermediate polyester 1 was prepared. The intermediate polyester 1 was found to have a number average molecular weight of 2,100, a weight average molecular weight of 9,500, a Tg of 55 degrees C., an acid value of 0.5 mgKOH/g, and a hydroxyl value of 51 mgKOH/g.

In another reaction vessel equipped with a condenser tube, a stirrer, and a nitrogen introducing tube, 410 parts of the intermediate polyester 1, 89 parts of isophorone diisocyanate, and 500 parts of ethyl acetate were put, then allowed to react at 100 degrees C. for 5 hours. Thus, a prepolymer 1 was prepared.

The proportion of free isocyanate in the prepolymer 1 was 1.53%.

Synthesis of Ketimine

In a reaction vessel equipped with a stirrer and a thermometer, 170 parts of isophoronediamine and 75 parts of methyl ethyl ketone were put and allowed to react at 50 degrees C. for 5 hours. Thus, a ketimine compound 1 was prepared.

The ketimine compound 1 was found to have an amine value of 418 mgKOH/g.

Preparation of Master Batch

First, 1,200 parts of water, 540 parts of a carbon black (PRINTEX 35 manufactured by Degussa AG, having a DBP oil absorption of 42 mL/100 mg and a pH of 9.5), and 1,200 parts of the amorphous polyester resin 1 were mixed using a HENSCHEL MIXER (manufactured by Mitsui Mining Co., Ltd.). The mixture was kneaded with a double roll at 150 degrees C. for 30 minutes, thereafter rolled to cool, and pulverized using a pulverizer. Thus, a master batch 1 was prepared.

Preparation of Wax Dispersion Liquid

In a vessel equipped with a stirrer and a thermometer, 50 parts of a paraffin wax (HNP-9 manufactured by NIPPON SEIRO CO., LTD., a hydrocarbon wax having a melting point of 75 degrees C. and a solubility parameter (SP) of 8.8) serving as a release agent 1 and 450 parts of ethyl acetate were put, then heated to 80 degrees C. while being stirred, maintained at 80 degrees C. for 5 hours, and cooled to 30 degrees C. over a period of 1 hour. The resulting liquid was subjected to a dispersion treatment using a bead mill (ULTRAVISCOMILL manufactured by AIMEX CO., LTD.) filled with 80% by volume of zirconia beads having a diameter of 0.5 mm, at a liquid feeding speed of 1 kg/hour and a disc peripheral speed of 6 m/sec. This dispersing operation was repeated 3 times (3 passes). Thus, a wax dispersion liquid 1 was prepared.

Preparation of Oil Phase

In a vessel, 500 parts of the wax dispersion liquid 1, 200 parts of the prepolymer 1, 500 parts of the crystalline polyester resin dispersion liquid 2, 750 parts of the amorphous polyester resin 1, 100 parts of the master batch 1, and 2 parts of the ketimine compound 1 as a curing agent were mixed using a TK HOMOMIXER (manufactured by Tokushu Kika Kogyo Co., Ltd. (now PRIMIX Corporation)) at a revolution of 5,000 rpm for 60 minutes. Thus, an oil phase 1 was prepared.

Synthesis of Fine Organic Particle Emulsion (Fine Particle Dispersion Liquid)

In a reaction vessel equipped with a stirrer and a thermometer, 683 parts of water, 11 parts of a sodium salt of a sulfate of ethylene oxide adduct of methacrylic acid (ELEMINOL RS-30 manufactured by Sanyo Chemical Industries, Ltd.), 138 parts of styrene, 138 parts of methacrylic acid, and 1 part of ammonium persulfate were put and stirred at a revolution of 400 rpm for 15 minutes. Thus, a white emulsion was prepared. The white emulsion was heated to 75 degrees C. and subjected to a reaction for 5 hours. A 1% aqueous solution of ammonium persulfate in an amount of 30 parts was further added to the emulsion, and the emulsion was aged at 75 degrees C. for 5 hours. Thus, a fine particle dispersion liquid 1 was prepared, which was an aqueous dispersion liquid of a vinyl resin (i.e., a copolymer of styrene, methacrylic acid, and a sodium salt of a sulfate of ethylene oxide adduct of methacrylic acid).

The volume average particle diameter of the fine particle dispersion liquid 1 was 0.14 μm when measured by an instrument LA-920 (manufactured by HORIBA, Ltd.).

A part of the fine particle dispersion liquid 1 was dried to isolate the resin component.

Preparation of Aqueous Phase

An aqueous phase 1 was prepared by stir-mixing 990 parts of water, 83 parts of the fine particle dispersion liquid 1, 37 parts of a 48.5% aqueous solution of sodium dodecyl diphenyl ether disulfonate (ELEMINOL MON-7 manufactured by Sanyo Chemical Industries, Ltd.), and 90 parts of ethyl acetate. The aqueous phase 1 was a milky white liquid.

Emulsification and Solvent Removal

In the vessel containing the oil phase 1, 1,200 parts of the aqueous phase 1 were put and mixed with the oil phase 1 using a TK HOMOMIXER at a revolution of 13,000 rpm for 20 minutes. Thus, an emulsion slurry 1 was prepared.

The emulsion slurry 1 was put in a vessel equipped with a stirrer and a thermometer and subjected to solvent removal at 30 degrees C. for 8 hours and subsequently to aging at 45 degrees C. for 4 hours. Thus, a dispersion slurry 1 was prepared.

Washing, Heating, and Drying

After 100 parts of the dispersion slurry 1 were filtered under reduced pressures:

(1) 100 parts of ion-exchange water were added to the resulted filter cake and mixed using a TK HOMOMIXER (at a revolution of 12,000 rpm for 10 minutes), followed by filtration;

(2) 100 parts of a 10% aqueous solution of sodium hydroxide were added to the filter cake of (1) and mixed using a TK HOMOMIXER (at a revolution of 12,000 rpm for 30 minutes), followed by filtration under reduced pressures;

(3) 100 parts of a 10% aqueous solution of hydrochloric acid were added to the filter cake of (2) and mixed using a TK HOMOMIXER (at a revolution of 12,000 rpm for 10 minutes, followed by filtration;

(4) 300 parts of ion-exchange water were added to the filter cake of (3) and mixed using a TK HOMOMIXER (at a revolution of 12,000 rpm for 10 minutes), followed by filtration. These operations (1) to (4) were repeated twice.

(5) 100 parts of ion-exchange water were added to the filter cake of (4) and mixed using a TK HOMOMIXER (at a revolution of 12,000 rpm for 10 minutes), then heated at 50 degrees C. for 4 hours, followed by filtration, thus preparing a filter cake 1.

(6) The final filter cake 1 was dried by a circulating air dryer at 45 degrees C. for 48 hours and then filtered with a mesh having an opening of 75 μm. Thus, toner base particles 1 were prepared.

Next, 100 parts of the toner base particles 1 were mixed with 2.0 parts of a hydrophobic silica A1 having a volume average primary particle diameter of 160 nm and 1.5 parts of a hydrophobic silica B1 having a volume average primary particle diameter of 20 nm using a HENSCHEL MIXER (manufactured by Mitsui Mining Co., Ltd.) at a peripheral speed of 40 nm and a stirring time of 6 minutes. Thus, a toner 1 was prepared.

The toner 1 was found to have a volume average particle diameter of 5.5 μm, the ratio of the volume average particle diameter to the number average particle diameter was 1.1, and the proportion of components having a volume average particle diameter of 2 μm or less was 4% by number.

The liberation ratio Xs of the silica particles liberated from the toner measured by the ultrasonic vibration method and the proportion R70 of the silica particles having a volume-based particle diameter of 70 nm or more in the silica particles liberated from the toner were measured as described above.

Example 2

Cleaning Blade

A blade (b) having a Martens hardness of 3 N/mm$^2$, a Tan δ peak temperature of 4 degrees C., and an elastic power of 92% was used.

An image forming apparatus was prepared in the same manner as in Example 1 except for replacing the blade (a) with the blade (b), and the following evaluation was performed.

Example 3

Cleaning Blade

A blade (c) having a Martens hardness of 8 N/mm$^2$, a Tan δ peak temperature of 5 degrees C., and an elastic power of 76% was used.

An image forming apparatus was prepared in the same manner as in Example 1 except for replacing the blade (a) with the blade (c), and the following evaluation was performed.

Example 4

Cleaning Blade

A blade (d) having a Martens hardness of 6 N/mm$^2$, a Tan δ peak temperature of 0 degrees C., and an elastic power of 88% was used.

An image forming apparatus was prepared in the same manner as in Example 1 except for replacing the blade (a) with the blade (d), and the following evaluation was performed.

Example 5

Preparation of Toner

An image forming apparatus was prepared in the same manner as in Example 1 except for changing the stirring time of the HENSCHEL MIXER (manufactured by Mitsui Mining Co., Ltd.) for mixing the silica particles to 3 minutes, and the following evaluation was performed.

Example 6

Preparation of Toner

An image forming apparatus was prepared in the same manner as in Example 1 except for replacing the hydrophobic silica having an average particle diameter of 160 nm with another hydrophobic silica A2 having an average particle diameter of 70 nm, and the following evaluation was performed.

Example 7

Preparation of Toner

An image forming apparatus was prepared in the same manner as in Example 1 except for replacing the hydrophobic silica having an average particle diameter of 160 nm with another hydrophobic silica A3 having an average particle diameter of 220 nm, and the following evaluation was performed.

Example 8

Preparation of Toner

An image forming apparatus was prepared in the same manner as in Example 1 except for changing the amount of the hydrophobic silica having an average particle diameter of 160 nm from 2.0 parts to 1.2 parts, and the following evaluation was performed.

Example 9

Preparation of Toner

An image forming apparatus was prepared in the same manner as in Example 1 except for changing the amount of the hydrophobic silica having an average particle diameter of 160 nm from 2.0 parts to 4.0 parts, and the following evaluation was performed.

Example 10

Preparation of Toner

An image forming apparatus was prepared in the same manner as in Example 1 except for replacing the hydrophobic silica having an average particle diameter of 20 nm with another hydrophobic silica B2 having an average particle diameter of 15 nm, and the following evaluation was performed.

Example 11

Preparation of Toner

An image forming apparatus was prepared in the same manner as in Example 1 except for replacing the hydrophobic silica having an average particle diameter of 20 nm with another hydrophobic silica B3 having an average particle diameter of 50 nm, and the following evaluation was performed.

Example 12

Preparation of Toner

An image forming apparatus was prepared in the same manner as in Example 1 except for changing the amount of the hydrophobic silica having an average particle diameter of 20 nm from 1.5 parts to 0.6 parts, and the following evaluation was performed.

Example 13

Preparation of Toner

An image forming apparatus was prepared in the same manner as in Example 1 except for changing the amount of the hydrophobic silica having an average particle diameter of 160 nm from 2.0 parts to 3.0 parts and changing the amount of the hydrophobic silica having an average particle diameter of 20 nm from 1.5 parts to 2.7 parts, and the following evaluation was performed.

Comparative Example 1

Cleaning Blade

A blade (e) having a Martens hardness of 2 N/mm$^2$, a Tan δ peak temperature of 4 degrees C., and an elastic power of 94% was used.

An image forming apparatus was prepared in the same manner as in Example 1 except for replacing the blade (a) with the blade (e), and the following evaluation was performed.

Comparative Example 2

Cleaning Blade

A blade (f) having a Martens hardness of 9 N/mm$^2$, a Tan δ peak temperature of 5 degrees C., and an elastic power of 71% was used.

An image forming apparatus was prepared in the same manner as in Example 1 except for replacing the blade (a) with the blade (f), and the following evaluation was performed.

Comparative Example 3

An image forming apparatus was prepared in the same manner as in Example 1 except for replacing the hydrophobic silica having an average particle diameter of 160 nm with another hydrophobic silica B3 having an average particle diameter of 50 nm, and the following evaluation was performed.

Comparative Example 4

An image forming apparatus was prepared in the same manner as in Example 1 except for replacing 2.0 parts of the hydrophobic silica having an average particle diameter of 160 nm with 4.0 parts of another hydrophobic silica A3 having an average particle diameter of 220 nm and changing the stirring time of the HENSCHEL MIXER (manufactured by Mitsui Mining Co., Ltd.) for mixing the silica particles to 3 minutes, and the following evaluation was performed.

Comparative Example 5

An image forming apparatus was prepared in the same manner as in Example 1 except for changing the amount of the hydrophobic silica having an average particle diameter of 160 nm from 2.0 parts to 1.0 part and changing the amount of the hydrophobic silica having an average particle diameter of 20 nm from 1.5 parts to 3.0 parts, and the following evaluation was performed.

Evaluations

Preparation of Image Forming Apparatus

The above-prepared cleaning blade was mounted on a process cartridge of a color multifunction peripheral (IMAGIO MP C4500 manufactured by Ricoh Co., Ltd.), the printer part of which having the same configuration as the printer 500 illustrated in FIG. 5, to assemble an image forming apparatus in each Example or Comparative Example.

The cleaning blade was mounted on the image forming apparatus with a linear pressure of 15 g/cm and a cleaning angle of 79 degrees. The image forming apparatus was equipped with a lubricant application device. The coefficient of static friction of the surface of the photoconductor was maintained at 0.2 or less during non-image forming periods by application of the lubricant to the photoconductor. The coefficient of static friction of the surface of the photoconductor was measured based on the Euler belt method described in, for example, paragraph [0046] of JP-H09-166919-A.

Cleaning Performance

In a laboratory environment at 21 degrees C. and 65% RH, an image chart having an image area ratio of 5% was output on 50,000 sheets (A4 size, lateral) at 3 prints/job using the image forming apparatus.

After that, in a laboratory environment at 10 degrees C. and 15% RH, a test image chart having three vertical band patterns (in the sheet advancing direction) having a width of 43 mm was output on 100 sheets (A4 size, lateral). The resultant image was visually observed to confirm the presence or absence of an image abnormality due to defective cleaning, and the cleaning performance was evaluated based on the following criteria.

Evaluation Criteria

A+: Toner particles having slipped through due to defective cleaning are not visually confirmed on either the print sheet or the photoconductor, and no streak-like toner slippage is confirmed even when the photoconductor is observed with a microscope in the longitudinal direction.

A: Toner particles having slipped through due to defective cleaning are not visually confirmed on either the print sheet or the photoconductor.

B: Toner particles having slipped through due to defective cleaning are slightly confirmed on the photoconductor but not confirmed on the print sheet.

C: Toner particles having slipped through due to defective cleaning are visually confirmed on either the print sheet or the photoconductor.

Filming of Additives

In a laboratory environment of 27 degrees C. and 90% RH, a vertical band chart having an image area ratio of 30% was output on 5,000 sheets (A4 size, lateral) at 3 prints/job, then 5,000 blank sheets (A4 size, lateral) were output at 3 prints/job, and a halftone image was printed on one sheet, using the image forming apparatus. After that, the photoconductor was visually observed.

Evaluation Criteria

A+: No problem with the photoconductor. No problem in quality.

A: Filming is slightly observed in the direction of printing, but there is no problem in image quality. No problem.

B: Filming is observed on the photoconductor, but there is no problem in image quality. No problem.

C: Filming is clearly observed on the photoconductor, and there is a problem in image quality.

Blade Chipping

In a laboratory environment of 10 degrees C. and 15% RH, a vertical band chart having an image area ratio of 0.5% was output on 5,000 sheets (A4 size, lateral) at 3 prints/job, then 5,000 blank sheets (A4 size, lateral) were output at 3 prints/job, and a halftone image was printed on one sheet, using the image forming apparatus. After that, the blade was visually observed.

Evaluation Criteria

A+: No chipping on the blade. No problem in quality.

A: Blade chipping is observed, but there is no problem in image quality. No problem.

B: Blade chipping is observed, and defective cleaning and filming are observed on the photoconductor, but there is no problem in image quality. No problem.

C: Blade chipping is clearly observed, and there is a problem in image quality.

The results are presented in Table 1.

TABLE 1

| | Toner | | | Silica A | | | Silica B | | |
|---|---|---|---|---|---|---|---|---|---|
| | Name | Silica liberation ratio Xs (%) | R70 (%) | Name | Volume average primary particle diameter (nm) | Addition amount (parts by weight) | Name | Volume average primary particle diameter (nm) | Addition amount (parts by weight) |
| Example 1 | Toner 1 | 57 | 75 | Silica A1 | 160 | 2 | Silica B1 | 20 | 1.5 |
| Example 2 | Toner 1 | 57 | 75 | Silica A1 | 160 | 2 | Silica B1 | 20 | 1.5 |
| Example 3 | Toner 1 | 57 | 75 | Silica A1 | 160 | 2 | Silica B1 | 20 | 1.5 |
| Example 4 | Toner 1 | 57 | 75 | Silica A1 | 160 | 2 | Silica B1 | 20 | 1.5 |
| Example 5 | Toner 2 | 74 | 85 | Silica A1 | 160 | 2 | Silica B1 | 20 | 1.5 |
| Example 6 | Toner 3 | 51 | 78 | Silica A2 | 70 | 2 | Silica B1 | 20 | 1.5 |
| Example 7 | Toner 4 | 69 | 83 | Silica A3 | 220 | 2 | Silica B1 | 20 | 1.5 |
| Example 8 | Toner 5 | 59 | 75 | Silica A1 | 160 | 1.2 | Silica B1 | 20 | 1.5 |
| Example 9 | Toner 6 | 64 | 71 | Silica A1 | 160 | 4 | Silica B1 | 20 | 1.5 |
| Example 10 | Toner 7 | 51 | 78 | Silica A1 | 160 | 2 | Silica B2 | 15 | 1.5 |
| Example 11 | Toner 8 | 63 | 77 | Silica A1 | 160 | 2 | Silica B3 | 50 | 1.5 |
| Example 12 | Toner 9 | 42 | 73 | Silica A1 | 160 | 2 | Silica B1 | 20 | 0.6 |
| Example 13 | Toner 10 | 67 | 71 | Silica A1 | 160 | 3 | Silica B1 | 20 | 2.7 |
| Comparative Example 1 | Toner 1 | 57 | 75 | Silica A1 | 160 | 2 | Silica B1 | 20 | 1.5 |

TABLE 1-continued

| | | | | | | | | | |
|---|---|---|---|---|---|---|---|---|---|
| Comparative Example 2 | Toner 1 | 57 | 75 | Silica A1 | 160 | 2 | Silica B1 | 20 | 1.5 |
| Comparative Example 3 | Toner 11 | 34 | 58 | Silica B3 | 50 | 2 | Silica B1 | 20 | 1.5 |
| Comparative Example 4 | Toner 12 | 76 | 86 | Silica A3 | 220 | 4 | Silica B1 | 20 | 1.5 |
| Comparative Example 5 | Toner 13 | 53 | 24 | Silica A1 | 160 | 1 | Silica B1 | 20 | 3 |

| | Blade | | | | Durability evaluations | | |
|---|---|---|---|---|---|---|---|
| | Name | Martens hardness ($N/mm^2$) | Tanδ peak temperature (deg. C.) | Elastic power (%) | Cleaning performance | Filming | Blade chipping |
| Example 1 | Blade (a) | 5 | 4 | 90 | A | A | A |
| Example 2 | Blade (b) | 3 | 4 | 92 | A | B | A+ |
| Example 3 | Blade (c) | 8 | 5 | 76 | A+ | A+ | B |
| Example 4 | Blade (d) | 6 | 0 | 88 | A+ | A | A |
| Example 5 | Blade (a) | 5 | 4 | 90 | A+ | B | A+ |
| Example 6 | Blade (a) | 5 | 4 | 90 | B | A | B |
| Example 7 | Blade (a) | 5 | 4 | 90 | A+ | A | A |
| Example 8 | Blade (a) | 5 | 4 | 90 | B | A | A |
| Example 9 | Blade (a) | 5 | 4 | 90 | A+ | B | A+ |
| Example 10 | Blade (a) | 5 | 4 | 90 | A | A | A |
| Example 11 | Blade (a) | 5 | 4 | 90 | A | A | A |
| Example 12 | Blade (a) | 5 | 4 | 90 | A | A+ | A |
| Example 13 | Blade (a) | 5 | 4 | 90 | A | B | A |
| Comparative Example 1 | Blade (e) | 2 | 4 | 94 | B | C | A+ |
| Comparative Example 2 | Blade (f) | 9 | 5 | 71 | A+ | A+ | C |
| Comparative Example 3 | Blade (a) | 5 | 4 | 90 | C | A | C |
| Comparative Example 4 | Blade (a) | 5 | 4 | 90 | A+ | C | A+ |
| Comparative Example 5 | Blade (a) | 5 | 4 | 90 | C | C | B |

It is clear from the above results that, in Examples 1 to 13, excellent results were obtained in the evaluations for filming, cleaning performance, and blade chipping. That is, by controlling the Martens hardness HM of the blade and the liberation ratio Xs and the proportion R70 (by number) of the silica particles of the toner, the properties relating to filming, cleaning performance, and blade chipping were improved.

By contrast, in Comparative Example 1, since the Martens hardness HM of the blade is less than the lower limit specified in the present disclosure, the scraping property was insufficient and the degree of external additive filming worsened.

In Comparative Example 2, since the Martens hardness HM of the blade was in excess of the upper limit specified in the present disclosure, blade chipping occurred.

In Comparative Example 3, since the liberation ratio Xs of the silica particles is less than the lower limit specified in the present disclosure, a dam layer was not formed at the blade nip portion and the lubrication function was insufficient, so that defective cleaning occurred and the degree of blade chipping worsened.

In Comparative Example 4, since the liberation ratio Xs of the silica particles was in excess of the upper limit specified in the present disclosure, the degree of filming worsened.

In Comparative Example 5, since the proportion R70 (by number) of silica particles having a volume-based diameter of 70 nm or more in the liberated silica particles was less than the lower limit specified in the present disclosure, cleaning performance and filming worsened.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus, comprising:

an image bearer; and a cleaning blade configured to remove toner particles remaining on the image bearer, the cleaning blade including:

an elastic member in contact with a surface of the image bearer to remove the toner particles, the elastic member having a Martens hardness of from 3 to 8 $N/mm^2$ when measured by a nanoindentation method with a load of 1 μN, wherein the toner particles comprise toner base particles and an external additive, the external additive comprising silica particles, wherein a liberation ratio (Xs) of the silica particles liberated from the toner particles is from 40% to 75% when measured by an ultrasonic vibration method, wherein a proportion (R70) of the silica particles having a volume-based particle diameter of 70 nm or more in the silica particles liberated from the toner particles is from 70% to 90% by number, and wherein the silica particles comprise:

at least two types of silica particles having different volume average particle diameters, including:

silica particles A having a volume average primary particle diameter of from 70 to 220 nm in an amount (Ma) of from 1 to 4 parts by mass based on 100 parts by mass of the toner base particles; and silica particles B having a volume average primary particle diameter of from 15 to 50 nm in an amount (Mb) of from 0.5 to 3 parts by mass based on 100 parts by mass of the toner base particles.

2. The image forming apparatus of claim 1, wherein the elastic member has a Tanδ peak temperature of 0.5 degrees C. or less.

3. The image forming apparatus of claim 1, wherein the elastic member has an elastic power of from 75% to 95%.

4. The image forming apparatus of claim 1, further comprising a charger configured to charge the image bearer by contact with the image bearer.

5. The image forming apparatus of claim 4, wherein the charger is configured to be applied with an alternating current voltage.

6. An image forming method, comprising:

removing toner particles remaining on an image bearer with a cleaning blade, wherein the cleaning blade includes an elastic member in contact with a surface of the image bearer to remove the toner particles, wherein the elastic member has a Martens hardness of from 3 to 8 $N/mm^2$ at a load of 1 μN when measured by a nanoindentation method, wherein the toner particles comprise toner base particles and an external additive, the external additive comprising silica particles, wherein a proportion (Xs) of the silica particles liberated from the toner particles is from 40% to 75% when measured by an ultrasonic vibration method, wherein a proportion (R70) of the silica particles having a volume-based particle diameter of 70 nm or more in the silica particles liberated from the toner particles is from 70% to 90% by number, and wherein the silica particles comprise:

at least two types of silica particles having different volume average particle diameters, including:

silica particles A having a volume average primary particle diameter of from 70 to 220 nm in an amount (Ma) of from 1 to 4 parts by mass based on 100 parts by mass of the toner base particles; and silica particles B having a volume average primary particle diameter of from 15 to 50 nm in an amount (Mb) of from 0.5 to 3 parts by mass based on 100 parts by mass of the toner base particles.

7. The image forming method of claim 6, wherein the elastic member has a Tanδ peak temperature of 5 degrees C. or less.

8. The image forming method of claim 6, wherein the elastic member has an elastic power of from 75% to 95%.

* * * * *